US012281460B2

(12) United States Patent
Horii et al.

(10) Patent No.: US 12,281,460 B2
(45) Date of Patent: Apr. 22, 2025

(54) MANIPULATOR MECHANISM AND WORKING MACHINE

(71) Applicant: KUBOTA CORPORATION, Osaka (JP)

(72) Inventors: Hiroshi Horii, Osaka (JP); Ryohei Masuda, Osaka (JP); Kunihiko Bito, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 92 days.

(21) Appl. No.: 18/206,328

(22) Filed: Jun. 6, 2023

(65) Prior Publication Data

US 2023/0313494 A1 Oct. 5, 2023

Related U.S. Application Data

(63) Continuation of application No. PCT/JP2021/048785, filed on Dec. 28, 2021.

(30) Foreign Application Priority Data

Jan. 27, 2021 (JP) ..... 2021-011437
Jan. 27, 2021 (JP) ..... 2021-011442
Jan. 27, 2021 (JP) ..... 2021-011443

(51) Int. Cl.
*E02F 9/20* (2006.01)
*E02F 9/16* (2006.01)

(52) U.S. Cl.
CPC ..... *E02F 9/2004* (2013.01); *E02F 9/166* (2013.01)

(58) Field of Classification Search
CPC ..... E02F 9/2004; E02F 9/166
See application file for complete search history.

(56) References Cited

U.S. PATENT DOCUMENTS 5,558,127 A 9/1996 Maruyama et al.
6,631,652 B1 10/2003 Okazawa et al.
(Continued)

FOREIGN PATENT DOCUMENTS

JP 60-053859 U1 4/1985
JP 5-106242 A 4/1993
(Continued)

OTHER PUBLICATIONS

International Search Report issued Mar. 29, 2022 in International Bureau of WIPO Patent Application No. PCT/JP2021/048785, with an English translation thereof.
(Continued)

*Primary Examiner* — Faye M Fleming
(74) *Attorney, Agent, or Firm* — Greenblum & Bernstein, P.L.C.

(57) ABSTRACT

A manipulator mechanism includes a rotary shaft rotatable about an axis extending in a first horizontal direction, an operation member disposed at one of opposite ends of the rotary shaft in an axial direction thereof to rotate together with the rotary shaft, an angle sensor disposed at the other of the opposite ends of the rotary shaft in the axial direction to detect a rotation angle of the rotary shaft, and a neutral return mechanism provided between the operation member and the angle sensor to return the operation member to a neutral position from a post-operation position which is a position to which the operation member has been moved.

17 Claims, 27 Drawing Sheets

(56) References Cited

U.S. PATENT DOCUMENTS

| | | | |
|---|---|---|---|
| 2019/0338493 | A1 | 11/2019 | Horii |
| 2020/0299931 | A1 | 9/2020 | Nishigori et al. |
| 2023/0324944 | A1 | 10/2023 | Horii et al. |

FOREIGN PATENT DOCUMENTS

| | | | | |
|---|---|---|---|---|
| JP | 6-2426 | U | | 1/1994 |
| JP | 6-37092 | Y | | 9/1994 |
| JP | 8-116719 | A | | 5/1996 |
| JP | 10-252100 | A | | 9/1998 |
| JP | 2000-148273 | A | | 5/2000 |
| JP | 2003-184128 | A | | 7/2003 |
| JP | 2003-184132 | A | | 7/2003 |
| JP | 2005-143887 | A | | 6/2005 |
| JP | 2006271270 | A | * | 10/2006 |
| JP | 2007-126898 | A | | 5/2007 |
| JP | 2007-239304 | A | | 9/2007 |
| JP | 2008-105598 | A | | 5/2008 |
| JP | 2008-254536 | A | | 10/2008 |
| JP | 2017211931 | A | * | 11/2017 |
| JP | 2019-020058 | A | | 2/2019 |
| JP | 2019-044353 | A | | 3/2019 |
| JP | 2019-116753 | A | | 7/2019 |
| JP | 2020044877 | A | | 3/2020 |
| WO | 2019/017188 | A1 | | 1/2019 |

OTHER PUBLICATIONS

International Preliminary Report on Patentability issued Jul. 31, 2023 in International Bureau of WIPO Patent Application No. PCT/JP2021/048785, with an English translation thereof.

Office Action issued in Japanese family member Patent Appl. No. 2021-011437, dated May 28, 2024, with an English translation thereof.

Office Action issued in Japanese family member Patent Appl. No. 2021-011442, dated Aug. 20, 2024, with an English translation thereof.

Co-pending U.S. Appl. No. 18/205,190, filed Jun. 2, 2023.

* cited by examiner

MANIPULATOR MECHANISM AND WORKING MACHINE

CROSS REFERENCE TO RELATED APPLICATIONS

This application is a continuation application of International Application No. PCT/JP2021/048785, filed on Dec. 28, 2021, which claims the benefit of priority to Japanese Patent Application No. 2021-011437, filed on Jan. 27, 2021, to Japanese Patent Application No. 2021-011442, filed on Jan. 27, 2021, and to Japanese Patent Application No. 2021-011443, filed on Jan. 27, 2021. The entire contents of each of these applications are hereby incorporated herein by reference.

BACKGROUND OF THE INVENTION

1. Field of the Invention

The present invention relates to a manipulator mechanism and a working machine.

2. Description of the Related Art

To date, a manipulator mechanism disclosed in Japanese Unexamined Patent Application Publication No. 2007-239304, a working machine disclosed in Japanese Unexamined Patent Application Publication No. 2007-126898, and a working machine disclosed in Japanese Unexamined Patent Application Publication No. 2019-116753 are known.

The manipulator mechanism disclosed in Japanese Unexamined Patent Application Publication No. 2007-239304 has a rotary shaft that is rotatable around an axis extending in a horizontal direction, and an operation member (dozer lever) that is disposed on one end of the rotary shaft in an axial direction thereof and that rotates together with the rotary shaft.

The working machine disclosed in Japanese Unexamined Patent Application Publication No. 2007-126898 is provided with a manipulator base provided forward of an operator's seat mounted on a machine body. A manipulator member that is grasped and operated is provided at the manipulator base.

The working machine disclosed in Japanese Unexamined Patent Application Publication No. 2019-116753 has a machine body on which an operator's seat is mounted. A manipulator base is provided beside the operator's seat at the machine body, and an unload lever and a manipulator member that operates a hydraulic actuator mounted at the working machine are provided at the manipulator base. The unload lever is configured to be switchable between a first orientation, in which an operator is prevented from sitting on and getting off the operator's seat, and a second orientation, in which the operator is allowed to sit on and get off the operator's seat. In the first orientation, an operation of an operation object that is operated by the manipulator member is allowed to be performed, and, in the second orientation, the operation of the operation object is prevented from being performed.

SUMMARY OF THE INVENTION

In a manipulator mechanism of the related art, a control valve unit that is operated by an operation member is disposed below a rotary shaft, and the control valve unit and the rotary shaft are connected to each other in an interlocked manner by a link mechanism. Therefore, the manipulator mechanism of the related art is long in an up-down direction. Consequently, there is a problem in that a lower space of the manipulator mechanism cannot be effectively used.

Incidentally, when an operator operates a manipulator member for a long time with his/her arm extended forward, the operator gets tired. In this case, an armrest extending toward an operator's seat from a side of a manipulator base may be provided at the manipulator base. When the operation member differing from the manipulator member above is provided beside the armrest at the manipulator base provided with the armrest, if an operation supporting mechanism that supports the operation member is provided below the armrest, there is a problem in that the knees and thighs of the operator come into contact with the operation supporting mechanism.

To date, when the armrest is provided at the manipulator base, the armrest is provided separately from an unload lever. In this case, the structure becomes complicated and costs are increased.

Preferred embodiments of the present invention provide manipulator mechanisms each of which makes it possible to effectively use a space below and working machines including such a manipulator mechanism.

Preferred embodiments of the present invention make it possible to prevent an operation supporting mechanism that supports an operation member from protruding below an armrest provided at a manipulator base.

Preferred embodiments of the present invention provide working machines whose structure is simplified and whose costs are reduced when a manipulator base is provided with an armrest and with a function of allowing and preventing an actuation of an operation object that is operated by an operation member.

A manipulator mechanism according to an aspect of the present invention includes: a rotary shaft rotatable about an axis extending in a first horizontal direction; an operation member disposed at one of opposite ends of the rotary shaft in an axial direction thereof to rotate together with the rotary shaft; an angle sensor disposed at the other of the opposite ends of the rotary shaft in the axial direction to detect a rotation angle of the rotary shaft; and a neutral return mechanism provided between the operation member and the angle sensor to return the operation member to a neutral position from a post-operation position, the post-operation position being a position to which the operation member has been moved.

The neutral return mechanism may include an interlock shaft disposed higher than the rotary shaft and extending in a second horizontal direction intersecting the first horizontal direction, an interlock arm to which one of opposite ends of the interlock shaft is pivotally supported and connected, the interlock arm being provided on the rotary shaft such that the interlock arm protrudes upward from the rotary shaft, and a neutral return spring including a coil spring fitted on the other of the opposite ends of the interlock shaft to bias the interlock shaft to return the operation member to the neutral position.

The neutral return mechanism may include a bracket member disposed higher than the rotary shaft and pivotally supporting a housing member that contains the other of the opposite ends of the interlock shaft and the neutral return spring.

The manipulator mechanism may further include: a swing restricting mechanism to limit an operation amount of the operation member from the neutral position, the swing restricting mechanism and the neutral return mechanism being arranged along the rotary shaft between the operation member and the angle sensor.

The swing restricting mechanism may include at least one supporting part protruding from the rotary shaft in the second horizontal direction, at least one restricting shaft attached to the at least one supporting part, and a contact member disposed higher than the rotary shaft, the contact member being configured to be contacted by the at least one restricting shaft when the operation member is in the post-operation position to restrict swinging of the operation member, the post-operation position being a position to which the operation member has been moved from the neutral position.

The at least one supporting part may include a first supporting part and a second supporting part protruding opposite to each other along the second horizontal direction from the rotary shaft. The at least one restricting shaft may include a first restricting shaft attached to the first supporting part and configured to contact the contact member when the operation member is moved in a first direction from the neutral position, and a second restricting shaft attached to the second supporting part and configured to contact the contact member when the operation member is moved in a second direction from the neutral position. The first restricting shaft and the second restricting shaft may be attached such that the first restricting shaft and the second restricting shaft are movable toward and away from the contact member.

The contact member may include a first restricting portion to be contacted by the first restricting shaft and a second restricting portion to be contacted by the second restricting shaft. The first restricting portion and the second restricting portion may be recessed upward from a lower surface of the contact member.

A working machine according to an aspect of the present invention includes any one of the manipulator mechanisms.

The working machine may further include: a machine body; an operator's seat on the machine body; a manipulator base provided forward of the operator's seat; an operation member swingable and disposed at the manipulator base; and an operation supporting mechanism to support the operation member. The manipulator base may include an armrest having a hollow and extending in a rearward direction away from the manipulator base. The operation supporting mechanism may include the neutral return mechanism and a swing restricting mechanism to limit an operation amount of the operation member from a neutral position thereof, and may be contained inside the hollow of the armrest.

A working machine according to another aspect of the present invention includes: a machine body; an operator's seat on the machine body; a manipulator base provided forward of the operator's seat; an operation member swingable and disposed at the manipulator base; and an operation supporting mechanism to support the operation member, wherein the manipulator base includes an armrest having a hollow and extending in a rearward direction away from the manipulator base, and the operation supporting mechanism includes a neutral return mechanism to return the operation member to a neutral position from a post-operation position and a swing restricting mechanism to limit an operation amount of the operation member from the neutral position, and is contained inside the hollow of the armrest, the post-operation position being a position to which the operation member has been moved.

The operation supporting mechanism may include a rotary shaft rotatable about an axis in response to a swinging operation of the operation member, and a shaft supporting member to support the rotary shaft such that the rotary shaft is rotatable about the axis. The rotary shaft may be disposed below an upper wall of the armrest and be disposed such that the rotary shaft protrudes in a machine-body width direction from one of opposite sides of the armrest in the machine-body width direction.

The neutral return mechanism may include a spring device disposed between the upper wall and the rotary shaft and including a neutral return spring to return the operation member to the neutral position, and a bracket member supporting the spring device and attached to the upper wall. A bracket attaching portion of the upper wall to which the bracket member is attached may be recessed in a direction from below to above.

The swing restricting mechanism and the neutral return mechanism may be arranged along the rotary shaft.

The swing restricting mechanism may include at least one supporting part fixed to the rotary shaft, a contact member facing the at least one supporting part, and at least one restricting shaft attached to the at least one supporting part such that the at least one restriction shaft is movable toward and away from the contact member and to restrict swinging of the operation member by contacting the contact member when the operation member swings from the neutral position.

The at least one supporting part may include a first supporting part protruding forward from the rotary shaft and a second supporting part protruding rearward from the rotary shaft. The at least one restricting shaft may include a first restricting shaft attached to the first supporting part and a second restricting shaft attached to the second supporting part. The contact member may be disposed above the rotary shaft, and include a first restricting portion contacted by the first restricting shaft when the operation member is operated in a first direction from the neutral position and a second restricting portion contacted by the second restricting shaft when the operation member is operated in a second direction from the neutral position. The first restricting portion and the second restricting portion may be recessed upward from a lower surface of the contact member.

The manipulator base may include a base portion extending upward from the machine body and a manipulator base body disposed on an upper portion of the base portion. The manipulator base body may include an attaching portion attached to the base portion, and the armrest. The armrest may include an armrest base provided beside the attaching portion, and an armrest body extending toward the operator's seat from the armrest base. The operation member may be located on the opposite side of the armrest base from the attaching portion The operation supporting mechanism may be contained in the armrest base.

The working machine may further include an angle sensor to detect an operation direction and an operation amount of the operation member. The angle sensor may be contained in the attaching portion.

The armrest may extend in a rearward direction away from one of opposite ends in a machine-body width direction of the manipulator base. The manipulator base may include a manipulator member attached to the manipulator base to be held and operated by an operator, and a flip-up armrest extending in a rearward direction away from the other of the opposite ends in the machine-body width direction of the manipulator base. The flip-up armrest may be configured to be switchable between a first orientation that does not allow the operator to sit on or get off the operator's seat and a second orientation that allows the operator to sit on and get off the operator's seat, and configured such that, when the flip-up armrest is in the first orientation, an actuation of an operation object to be operated by the manipulator member is allowed, and, when the flip-up armrest is in the second orientation, the actuation of the operation object is not allowed.

A working machine according to a further aspect of the present invention includes: a machine body; an operator's seat on the machine body; and a manipulator base provided forward of the operator's seat on the machine body and having attached thereto a manipulator member to be held and operated, wherein the manipulator base includes a flip-up armrest extending in a rearward direction away from the manipulator base, the flip-up armrest is configured to be switchable between a first orientation that does not allow an operator to sit on or get off the operator's seat and a second orientation that allows the operator to sit on and get off the operator's seat, and configured such that, when the flip-up armrest is in the first orientation, an actuation of an operation object to be operated by the manipulator member is allowed, and, when the flip-up armrest is in the second orientation, the actuation of the operation object is not allowed.

The manipulator base may include a base portion extending upward from the machine body, and a manipulator base body disposed on an upper portion of the base portion. The manipulator base body may include an attaching portion to be attached to the base portion, and the flip-up armrest. The flip-up armrest may include an armrest base provided beside the attaching portion, and an armrest body pivotally supported by the armrest base. The armrest body may be switchable between a lowered position in which the armrest body extends rearward from the armrest base such that the flip-up armrest is in the first orientation, and a raised position in which the armrest body has been rotated upward from the lowered position such that the flip-up armrest is in the second orientation.

The working machine further may include a detection switch to detect a position of the armrest body.

The working machine may further include a damper provided on one of the armrest base and the armrest body and configured to contact the other of the armrest base and the armrest body to reduce shock produced when the armrest body is rotated from the raised position to the lowered position.

The working machine may further include a holding mechanism to hold the armrest body in the lowered position and the raised position.

The working machine may further include a fixed-side member attached to the armrest base, and a shaft supported by the fixed-side member to rotate together with the armrest body. The fixed-side member may include a first supporting portion to support one of opposite ends of the shaft in an axial direction thereof, and a second supporting portion to support the other of the opposite ends of the shaft in the axial direction. The holding mechanism may be provided between the first supporting portion and the second supporting portion.

The holding mechanism may include a first member attached to the fixed-side member, a second member supported such that the second member is rotatable together with the shaft and slidable in an axial direction, and a spring member to push the second member against the first member.

The holding mechanism may include a cam protrusion provided on one of the first member and the second member, and a cam inclined surface provided on the other of the first member and the second member to contact the cam protrusion. The cam protrusion and the cam inclined surface may be configured to contact each other to cause a biasing force of the spring member to act such that the armrest body is rotated toward the lowered position at a position between (i) the lowered position and (ii) an intermediate position between the lowered position and the raised position, and that the armrest body is rotated toward the raised position at a position between the raised position and the intermediate position.

The holding mechanism may be configured such that, when the armrest body is in the raised position, the cam protrusion and the cam inclined surface contact each other to cause a biasing force of the spring member to act in a direction in which the armrest body is rotated from the lowered position to the raised position.

The working machine may further include: a damper provided on one of the armrest base and the armrest body and configured to contact the other of the armrest base and the armrest body to reduce shock produced when the armrest body is rotated from the raised position to the lowered position; and a moving-side member attached to the armrest body to rotate together with the shaft. The damper may be provided on the armrest base. The moving-side member may include a damper contacting portion to contact the damper.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
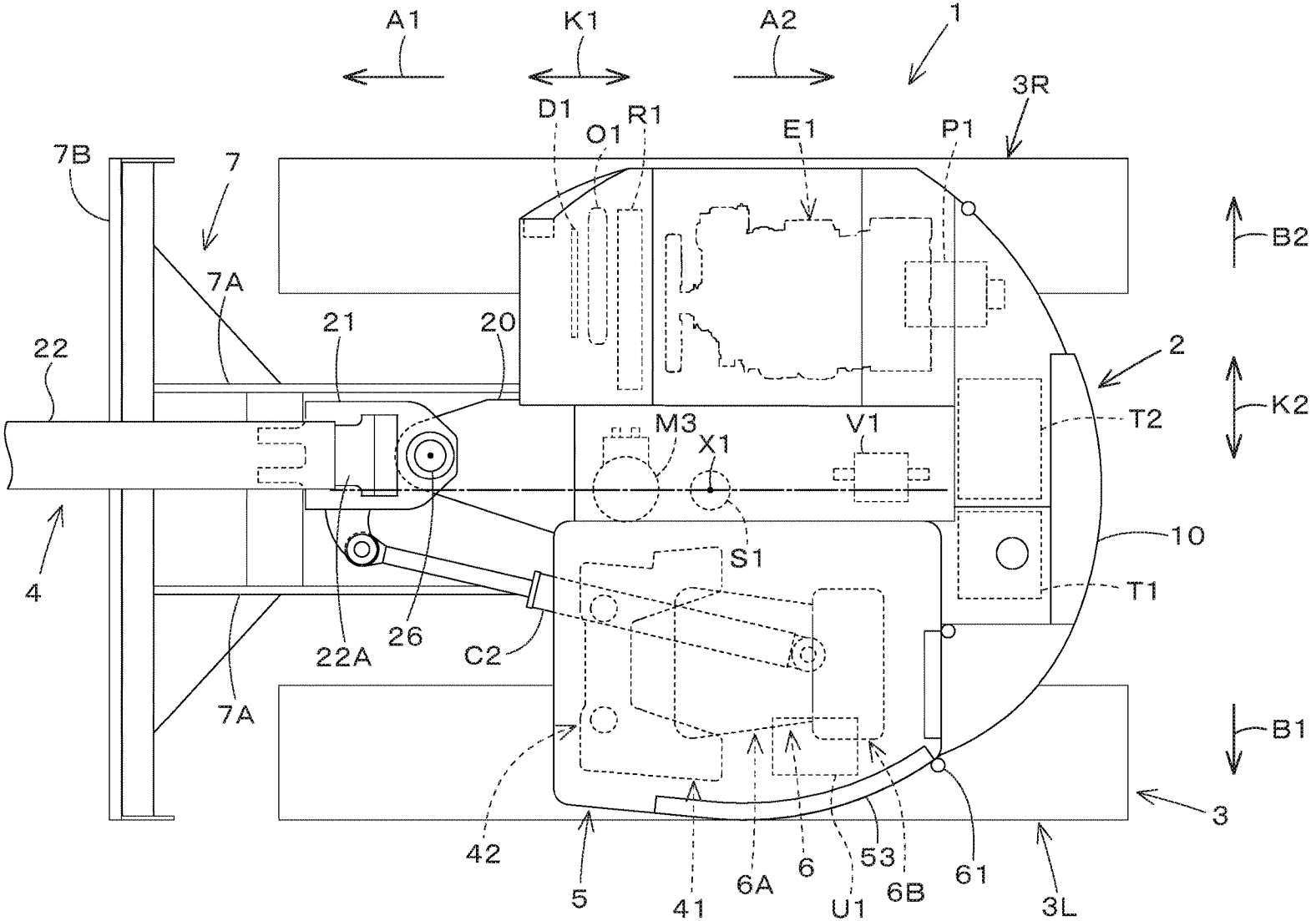
FIG. 1 is a plan view of a working machine.

The preferred embodiments will now be described with reference to the accompanying drawings, wherein like reference numerals designate corresponding or identical elements throughout the various drawings. The drawings are to be viewed in an orientation in which the reference numerals are viewed correctly.

An embodiment of the present invention is described below with reference to the drawings as appropriate.

Figure 2:
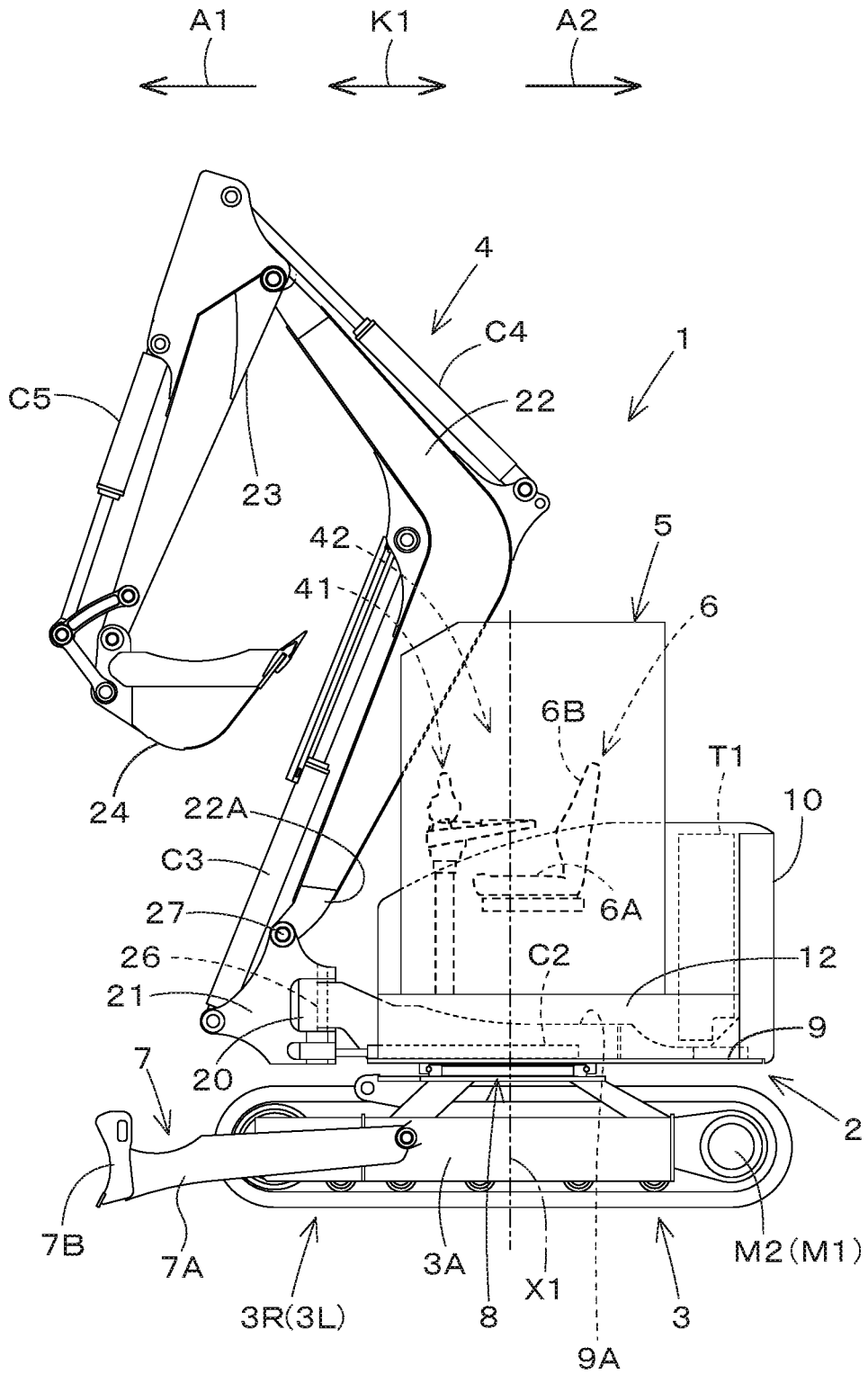
FIG. 2 is a side view of the working machine.

FIG. 1 is a schematic plan view showing the entire structure of a working machine 1 according to the present embodiment. FIG. 2 is a schematic side view of the working machine 1. In the present embodiment, a backhoe, which is a turning working machine, is described as an example of the working machine 1.

As shown in FIGS. 1 and 2, the working machine 1 includes a machine body (turning base) 2, at least one traveling device 3, and a working device 4. A cabin 5 is mounted on the machine body 2. An operator's seat (seat) 6 on which an operator sits is provided inside the cabin 5. In other words, the operator's seat 6 is mounted on the machine body 2, and the cabin 5 surrounds the operator's seat 6. The operator's seat 6 has a seat portion 6A that is a portion on which the operator sits and a backrest 6B that is a portion receiving the back of the operator.

In the present embodiment, a direction forward of an operator seated on the operator's seat 6 of the working machine 1 is described as being a forward direction (direction of arrow A1 in FIGS. 1 and 2), a direction rearward of the operator is described as being a rearward direction (direction of arrow A2 in FIGS. 1 and 2), a direction of arrow K1 in FIGS. 1 and 2 is described as being a front-rear direction, a left side of the operator (direction of arrow B1 in FIG. 1) is described as being a leftward direction, and a right side of the operator (direction of arrow B2 in FIG. 1) is described as being a rightward direction.

As shown in FIG. 1, a horizontal direction orthogonal to the front-rear direction K1 is described as being a machine-body width direction K2 (width direction of the machine body 2). A direction toward a right portion or a direction toward a left portion from a central portion of the machine body 2 in the width direction is described as being a machine-body outward direction (outward in terms of the machine-body width direction K2). In other words, the machine-body outward direction is defined in terms of the machine-body width direction K2 and is a direction away from the center of the machine body 2 in the width direction. A direction opposite to the machine-body outward direction is described as a machine-body inward direction (inward in terms of the machine-body width direction K2). In other words, the machine-body inward direction is defined in terms of the machine-body width direction K2 and is a direction toward the center of the machine body 2 in the width direction.

As shown in FIGS. 1 and 2, the at least one traveling device 3 is a crawler traveling device that supports the machine body 2 such that the machine body 2 is capable of traveling, and includes a traveling frame 3A, a first traveling device 3L provided on the left of the traveling frame 3A, and a second traveling device 3R provided on the right of the traveling frame 3A. The first traveling device 3L is driven by a first travel motor M1, and the second traveling device 3R is driven by a second travel motor M2. The first travel motor M1 and the second travel motor M2 are hydraulic motors (hydraulic actuators).

As shown in FIG. 2, a dozer device 7 is mounted on a front portion of each traveling device 3. The dozer device 7 has a dozer arm 7A whose rear portion is pivotally supported by the traveling frame 3A and that is swingable in an up-down direction, and a dozer blade 7B provided on a front portion of the dozer arm 7A. The dozer device 7 can be raised and lowered (the dozer blade 7B can be raised and lowered) by extending and contracting a dozer cylinder (hydraulic actuator).

As shown in FIG. 2, the machine body 2 is supported on the traveling frame 3A through a turning bearing 8 to be turnable around a turn axis X1. The machine body 2 is driven by being turned by a turn motor M3. The turn motor M3 is a hydraulic motor (hydraulic actuator, hydraulic device). The machine body 2 has a baseplate (hereunder referred to as "turning baseplate") 9 supported by the turning bearing 8 so as to be turnable around the turn axis X1. The turning baseplate 9 is formed from, for example, a steel plate, and constitutes a bottom portion of the machine body 2. A vertical rib 9A, which is a reinforcing member, is provided at a top surface of the turning baseplate 9 from a front portion to a rear portion thereof. By providing, in addition to the vertical rib 9A, for example, a supporting member that supports an object to be mounted, such as a device to be mounted on the machine body 2, on the turning baseplate 9, a turning frame, which becomes a framework of the machine body 2, is formed. The vicinity of the turning frame in a horizontal direction is covered by a turning cover 12.

As shown in FIGS. 1 and 2, a weight 10 is provided on a rear portion of the machine body 2, and a fuel tank T1 that stores fuel of a prime mover E1 and a hydraulic-fluid tank T2 that stores hydraulic fluid are disposed side by side in the machine-body width direction K2 forward of the weight 10.

As shown in FIG. 1, the cabin 5 is mounted on one side portion (left side portion) of the machine body 2 in the width direction K2. The prime mover E1 is mounted on the other side portion (right side portion) of the machine body 2 in the width direction K2. The prime mover E1 is a diesel engine. Note that the prime mover E1 may be a gasoline engine, an LPG engine, or an electric motor, or may be a hybrid type having an engine and an electric motor.

A hydraulic pump P1 is provided at a rear portion of the prime mover E1. The hydraulic pump P1 is driven by the prime mover E1 and compresses and delivers hydraulic fluid that is used in a hydraulic driving unit. The hydraulic driving unit is, for example, a hydraulic actuator mounted on the working machine 1. A radiator R1 that cools cooling water of the prime mover E1, an oil cooler O1 that cools hydraulic fluid, and a condenser D1 that cools refrigerant of an air conditioner mounted on the working machine 1 are disposed forward of the prime mover E1.

As shown in FIG. 1, a controller U1 is provided below the cabin 5. The controller U1 uses, for example, a microcomputer including a CPU (Central Processing Unit), EEPROM (Electrically Erasable Programmable Read-Only Memory), and the like.

A swivel joint (hydraulic device) S1 is provided at a position on the turn axis X1. The swivel joint S1 is a hydraulic device that causes hydraulic fluid to flow, and is a rotary joint that causes hydraulic fluid to flow between a hydraulic device of the machine body 2 and a hydraulic device of each traveling device 3. A control valve (hydraulic device) V1 is disposed rearward of the swivel joint S1. The control valve V1 is a hydraulic device formed by putting together control valve units that control hydraulic actuators, such as hydraulic motors and hydraulic cylinders, of the working machine 1. The control valve units constituting the control valve V1 are switching valves that switch the direction of hydraulic fluid with respect to the hydraulic actuators and are control valve units that are electrically controlled by the controller U1. For example, a solenoid valve is used for each control valve unit. The control valve units constituting the control valve V1 are control valve units that control, for example, a hydraulic attachment that is mounted in place of or in addition to the first travel motor M1, the second travel motor M2, the turn motor M3, the dozer cylinder, a swing cylinder C2, a boom cylinder C3, an arm cylinder C4, a bucket cylinder C5, or a bucket 24.

As shown in FIGS. 1 and 2, a swing bracket 21 is attached to a front portion (portion protruding from the machine body 2) of a support bracket 20 through a swing shaft 26 so as to be swingable around a vertical axis. The working device 4 is attached to the swing bracket 21.

As shown in FIG. 2, the working device 4 has a boom 22, an arm 23, and the bucket (working tool) 24. A base portion 22A of the boom 22 is pivotally attached to an upper portion of the swing bracket 21 through a boom pivot 27 so as to be rotatable around a horizontal axis (axis extending in the machine-body width direction K2). Therefore, the boom 22 is swingable in an up-down direction.

The arm 23 is pivotally attached to an end side of the boom 22 so as to be rotatable around a horizontal axis. Therefore, the arm 23 is swingable in a front-rear direction or an up-down direction. The bucket 24 is provided at an end side of the arm 23 so as to be capable of shoveling and dumping. Shoveling is an operation for swinging the bucket 24 in a direction toward the boom 22, and an example thereof is shoveling earth and sand or the like. Dumping is an operation for swinging the bucket 24 in a direction away from the boom 22, and an example thereof is causing shoveled earth and sand or the like to drop (to be discharged).

In place of or in addition to the bucket 24, other working tools (hydraulic attachments) that are drivable by hydraulic actuators can be mounted at the working machine 1. Such other working tools include, for example, a hydraulic breaker, a hydraulic crusher, an angle broom, an earth auger, a pallet fork, a sweeper, a mower, and a snow blower.

The swing bracket 21 is swingable due to extension and contraction of the swing cylinder C2 provided at the machine body 2. The boom 22 is swingable due to extension and contraction of the boom cylinder C3. The arm 23 is swingable due to extension and contraction of the arm cylinder C4. The bucket 24 is capable of performing shoveling and dumping due to extension and contraction of the bucket cylinder (working-tool cylinder) C5. The swing cylinder C2, the boom cylinder C3, the arm cylinder C4, and the bucket cylinder C5 are hydraulic cylinders (hydraulic actuators).

Figure 3:
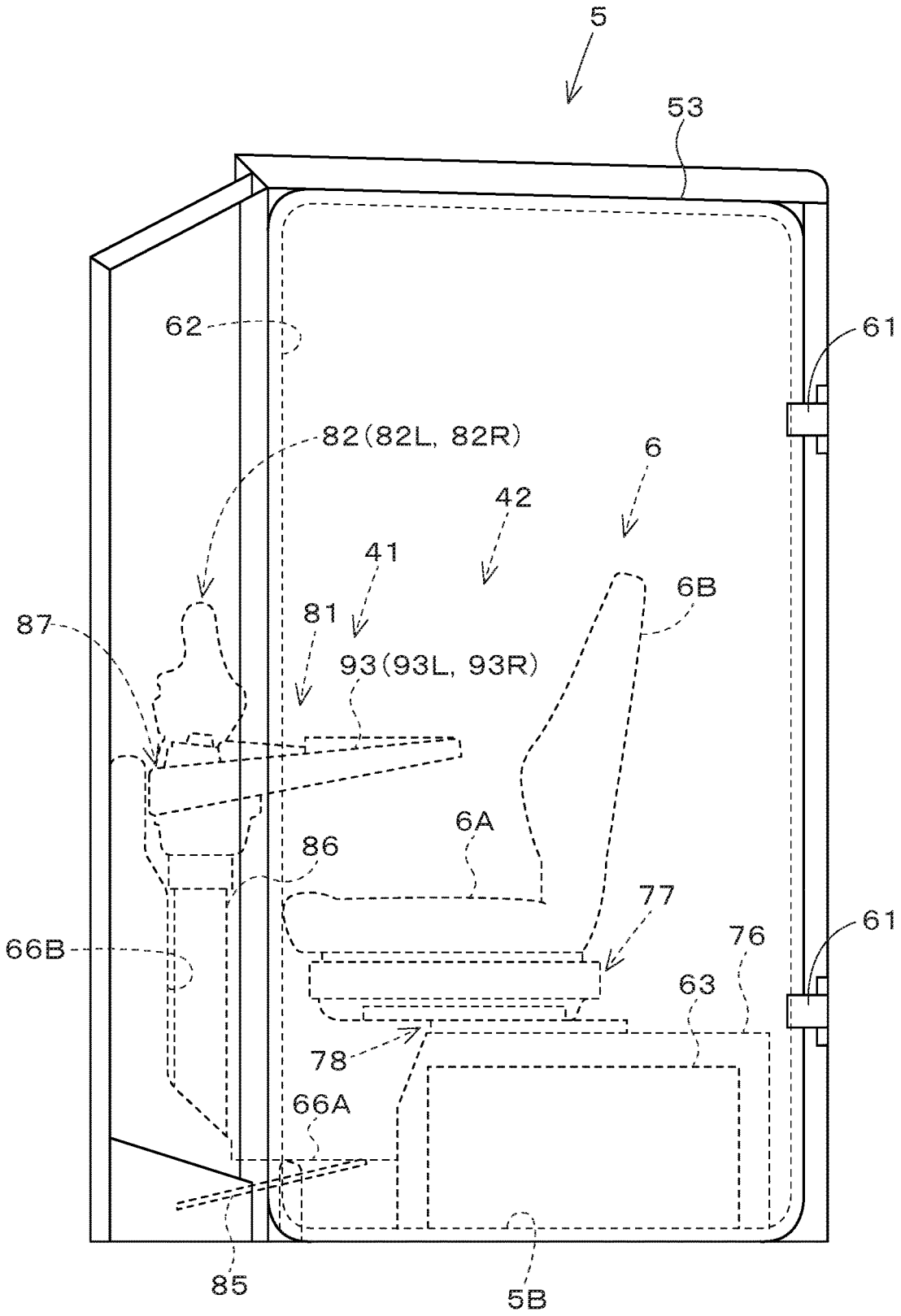
FIG. 3 is a side view of a cabin.

As shown in FIGS. 1 and 3, a door 53 is provided at a side surface (left side surface) of the cabin 5. The door 53 has its rear portion supported by a hinge 61 so as to be rotatable around a vertical axis, and when the door 53 rotates around the hinge 61, a front portion of the door 53 moves outward in the machine-body width direction K2 to open and close a doorway 62. The doorway 62 is an opening for allowing an operator to get into and out of the cabin 5 (sit on and get off the operator's seat 6).

As shown in FIG. 3, the operator's seat 6 is supported through, for example, a seat base 76 by a floor 5B constituting a bottom portion of the cabin 5. The operator's seat 6 is disposed at a central portion of the cabin 5 in the machine-body width direction K2. The seat base 76 is attached to the floor 5B and on the central portion of the cabin 5 in the machine-body width direction K2. A suspension device 77 is provided on the seat base 76, and the operator's seat 6 is provided on the suspension device 77 through slide rails 78 such that the position of the operator's seat 6 in a front-rear direction is adjustable.

An air-conditioner body 63 of an air conditioner is provided inside the seat base 76. The air-conditioner body 63 has an evaporator and a blower fan. Air-conditioning air blown out from the air-conditioner body 63 is guided to a duct 66B through a duct 66A and is blown out to a windshield of the cabin 5 from an air outlet provided in an upper portion of the duct 66B, the duct 66B being provided at a front portion of the inside of the cabin 5, the duct 66A being provided at a bottom portion of the inside of the cabin 5.

A manipulator device 41 is provided inside the cabin 5. The manipulator device 41 is provided forward of the operator's seat 6. The operator's seat 6 and the manipulator device 41 constitute an operation section 42 that operates the working machine 1 (manipulates, for example, the machine body 2, the traveling devices 3, the working device 4, and the swing bracket 21). Note that, although in the present embodiment, a structure in which the operation section 42 is disposed inside the cabin 5 (cabin specification) is described, it is not limited thereto. A structure in which portions in the front-rear direction K1 and the machine-body width direction K2 of the operation section 42 are open to the outside and an upper portion is covered by a roof (canopy) (canopy specification) may be used, or a structure in which the portions in the front-rear direction K1 and the machine-body width direction K2 of the operation section 42 and the upper portion thereof are open to the outside may be used.

Figure 4:
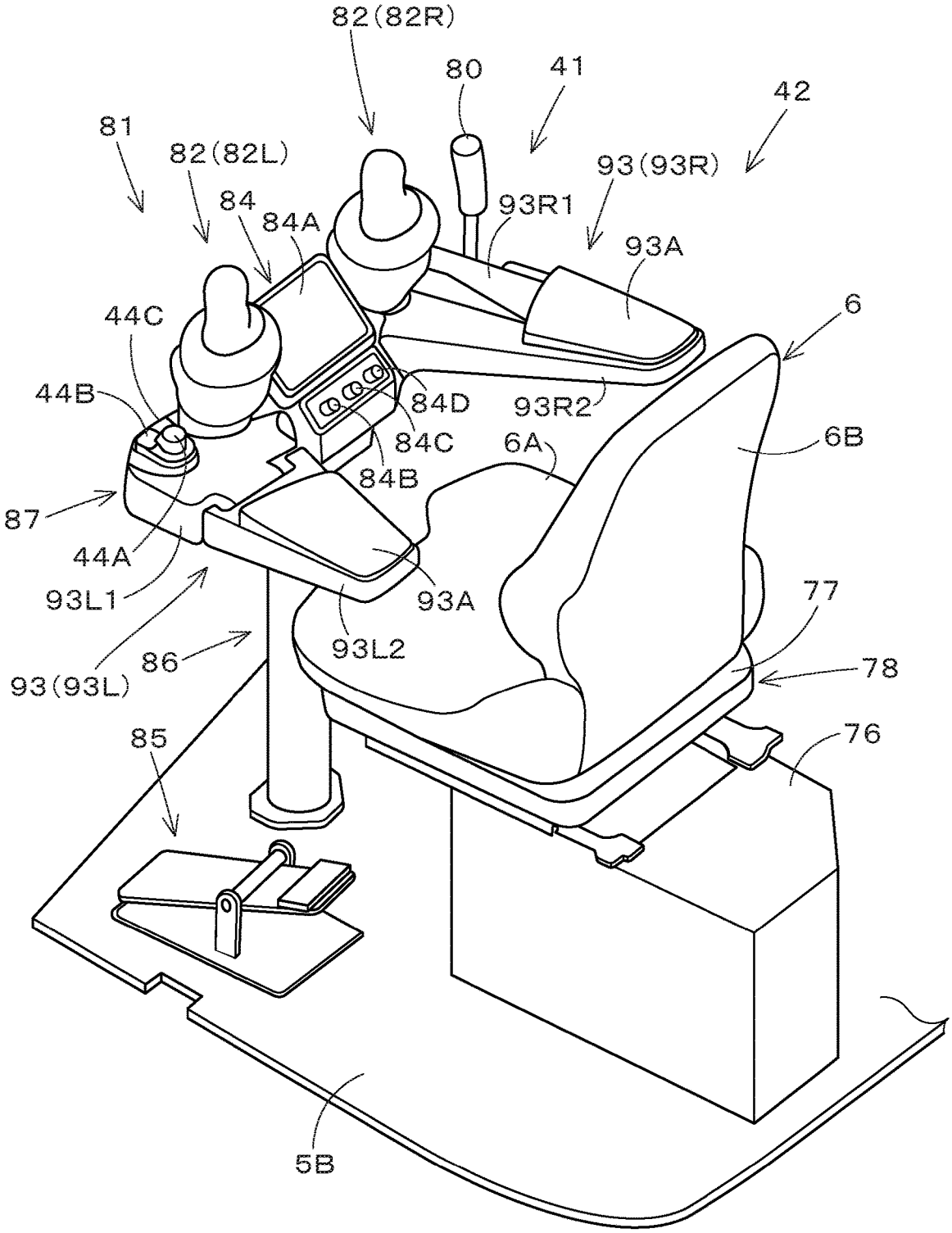
FIG. 4 is a perspective view of an operation section.

As shown in FIGS. 3 and 4, the manipulator device 41 has, for example, a manipulator base 81, at least one manipulator member 82, a monitor 84, at least one travel operation member 85, and an operation lever (operation member) 80.

As shown in FIG. 4, the manipulator base 81 is provided forward of the operator's seat 6 on the machine body 2. The manipulator base 81 is provided toward the center of the cabin 5 in the machine-body width direction K2. In other words, the manipulator base 81 is provided such that its center in the machine-body width direction K2 substantially coincides with the center of the cabin 5 in the machine-body width direction K2. The manipulator base 81 has a base portion 86 that is provided in a standing manner on the floor 5B (the machine body 2), and a manipulator base body 87 that is disposed on an upper portion of the base portion 86.

Figure 5:
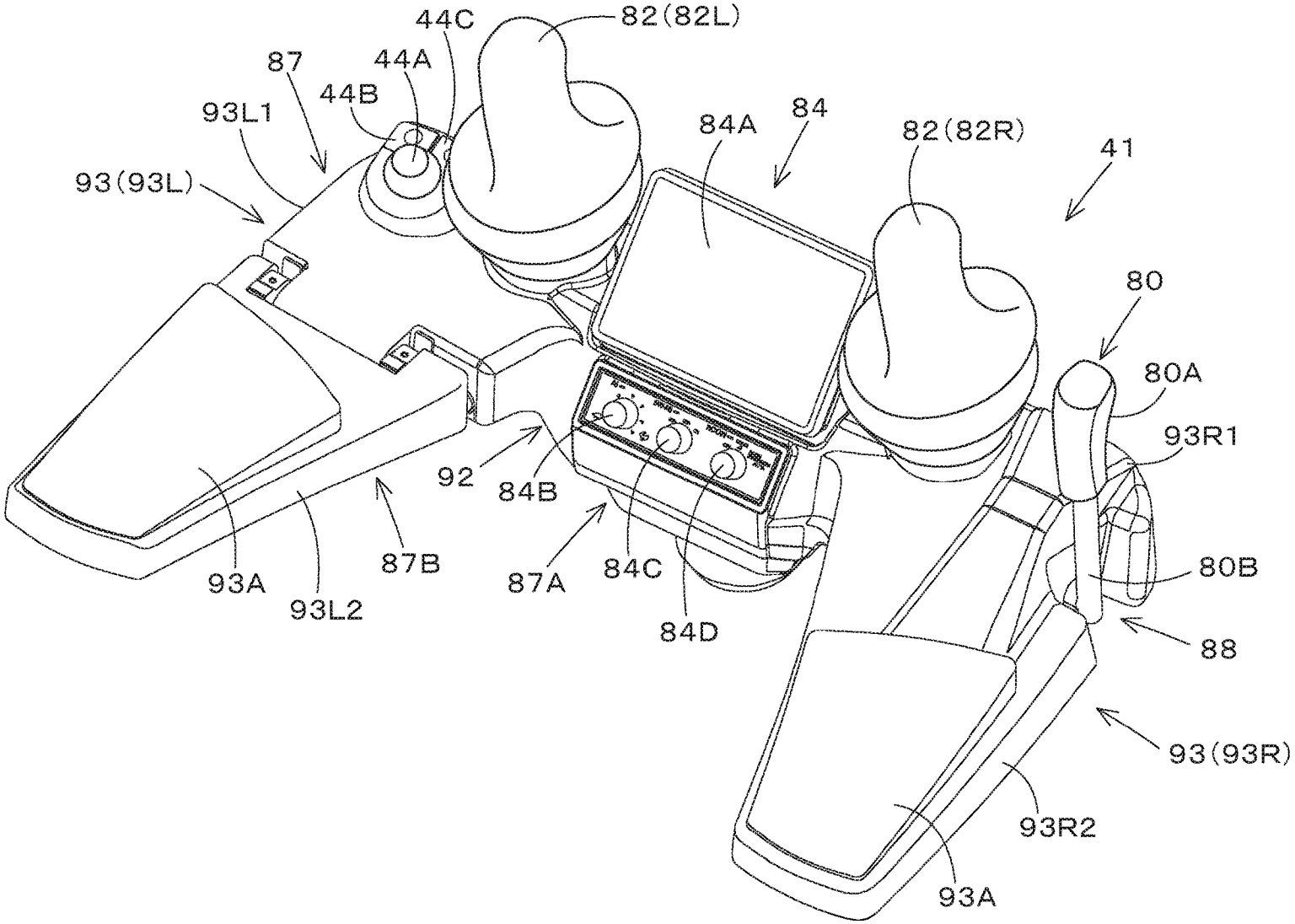
FIG. 5 is a perspective view of a manipulator base body.

As shown in FIGS. 4 and 5, the at least one manipulator member 82 is a member that is grasped and operated by an operator. The at least one manipulator member 82 is attached to the manipulator base body 87 (the manipulator base 81). The at least one manipulator member 82 includes a first manipulator handle 82L and a second manipulator handle 82R. The first manipulator handle 82L is provided on one side (left side) with respect to a central portion of the manipulator base body 87 in the machine-body width direction K2. The second manipulator handle 82R is provided on the other side (right side) of the central portion of the manipulator base body 87 in the machine-body width direction K2, and beside the first manipulator handle 82L in the machine-body width direction K2.

As shown in FIGS. 4 and 5, the first manipulator handle 82L and the second manipulator handle 82R are both devices capable of operating two operation objects provided at the working machine 1. The first manipulator handle 82L is, for example, capable of turning the machine body 2, which is a first operation object, and capable of swinging the arm 23, which is a second operation object. The second manipulator handle 82R is, for example, capable of swinging the bucket 24, which is a first operation object, and the boom 22, which is a second operation object. The operation direction and the swinging amount of each manipulator member 82 is detected by an angle sensor. A detection signal of the angle sensor is sent to the controller U1. The controller U1 controls each control valve unit that controls its corresponding operation object on the basis of the detection signal from the angle sensor.

As shown in FIGS. 4 and 5, the monitor 84 is disposed at a central portion in the machine-body width direction K2 on an upper surface of the manipulator base body 87 (between the first manipulator handle 82L and the second manipulator handle 82R), and is positioned forward of an operator that operates in a forwardly tilted posture the working machine 1 by grasping the first manipulator handle 82L and the second manipulator handle 82R. The monitor 84 has on its rear surface a display (screen) 84 that performs a display operation. The display 84A displays, for example, basic information about the working machine 1, images of the vicinity of the working machine 1, or information necessary for performing various settings of the working machine 1.

Below the display 84A of the monitor 84, a first switch 84B that is a switch that changes the rotation speed of the prime mover E1, a second switch 84C that is a switch that sets the working speed of the working machine 1, and a third switch 84D that is a switch that turns on and off, for example, a boom light, a headlight, or a rear light are provided.

Leftward of the first manipulator handle 82L, a plurality of operation tools (a first operation tool 44A, a second operation tool 44B, a third operation tool 44C) that perform operations regarding display items that are displayed on the screen are provided. By being rotated, the first operation tool 44A changes a selection item candidate among a plurality of selection items to be displayed on the display 84A. The third operation tool 44C determines a selection item by being pushed. The second operation tool 44B cancels the determined selection item by being pushed.

As shown in FIG. 4, the at least one travel operation member 85 is provided on the floor 5B. The at least one travel operation member 85 is provided, one on the left and one on the right of the base portion 86 of the manipulator base 81. The travel operation members (called traveling pedals) 85 are pedals that operate the traveling devices 3 by being stepped on, and the left traveling pedal 85 operates the first traveling device 3L (the first travel motor M1) and the right traveling pedal 85 operates the second traveling device 3R (the second travel motor M2). Detection of the step-on amount and the step-on direction of each traveling pedal 85 is performed by an angle sensor. A detection signal from the angle sensor is sent to the controller U1, and the controller U1 controls the control valve units that control the travel motors M1 and M2 on the basis of the detection signal from the angle sensor.

The operation lever 80 is a dozer lever that manipulates the dozer device 7.

Note that a swing operation member that swings the swing bracket 21 (for example, a seesaw switch (not shown) that is provided at an upper portion of the first manipulator handle 82L or the second manipulator handle 82R) is provided at the operation section 42. Detection of the step-on amount and the step-on direction of the swing operation member is also performed by an angle sensor. A detection signal from the angle sensor is sent to the controller U1, and the controller U1 controls the control valve unit that controls the swing cylinder on the basis of the detection signal from the angle sensor.

Figure 6:
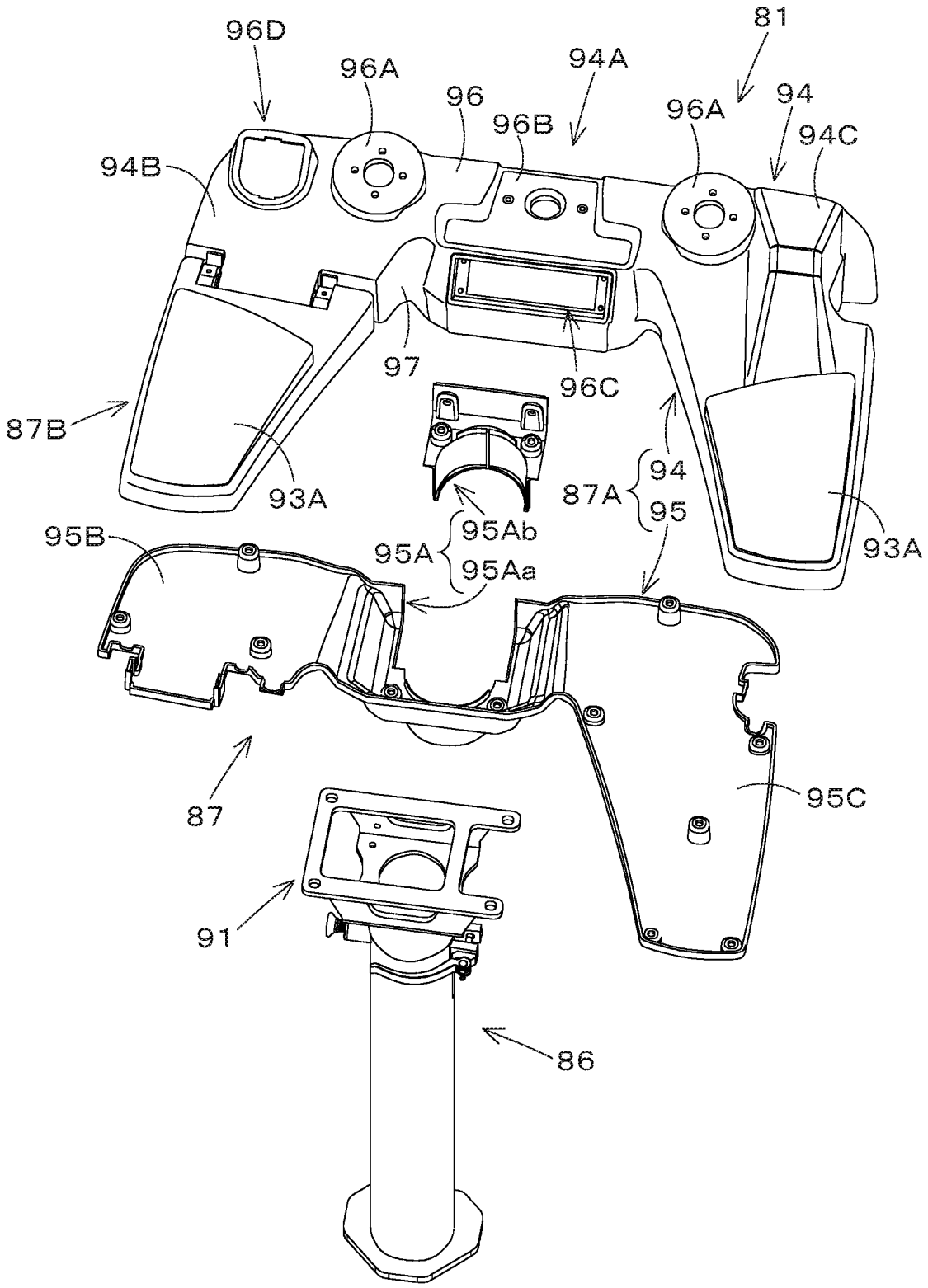
FIG. 6 is an exploded perspective view of a manipulator base.

As shown in FIG. 6, the base portion 86 has at its upper portion an attaching bracket 91 to which the manipulator base body 87 is attached. As shown in FIGS. 4 and 5, the manipulator base body 87 has an attaching portion 92 that is disposed at a central portion in the machine-body width direction K2, and armrests 93 that are disposed, one on the left and one on the right of the attaching portion 92. The attaching portion 92 is attached to the attaching bracket 91 at the base portion 86 so as to be attachable to and detachable from the attaching bracket 91. The armrest 93 positioned on the left (doorway 62 side) of the attaching portion 92 is called a first armrest (flip-up armrest) 93L, and the armrest 93 positioned on the right of the attaching portion 92 is called a second armrest 93R.

The first armrest 93L has an armrest base 93L1 that is provided on the left of the attaching portion 92, and an armrest body 93L2 that is pivotally supported on a rear portion of the armrest base 93L1. The second armrest 93R has an armrest base 93R1 that is provided on the right of the attaching portion 92, and an armrest body 93R2 that is integrally formed with the armrest base 93R1.

The armrest body 93L2 extends rearward (toward the operator's seat 6) from the armrest base 93L1. The armrest body 93R2 also extends rearward (toward the operator's seat 6) from the armrest base 93R1. That is, each armrest 93 is provided at the manipulator base 81, and extends toward the operator's seat 6 from a side of the manipulator base 81.

Figure 9:
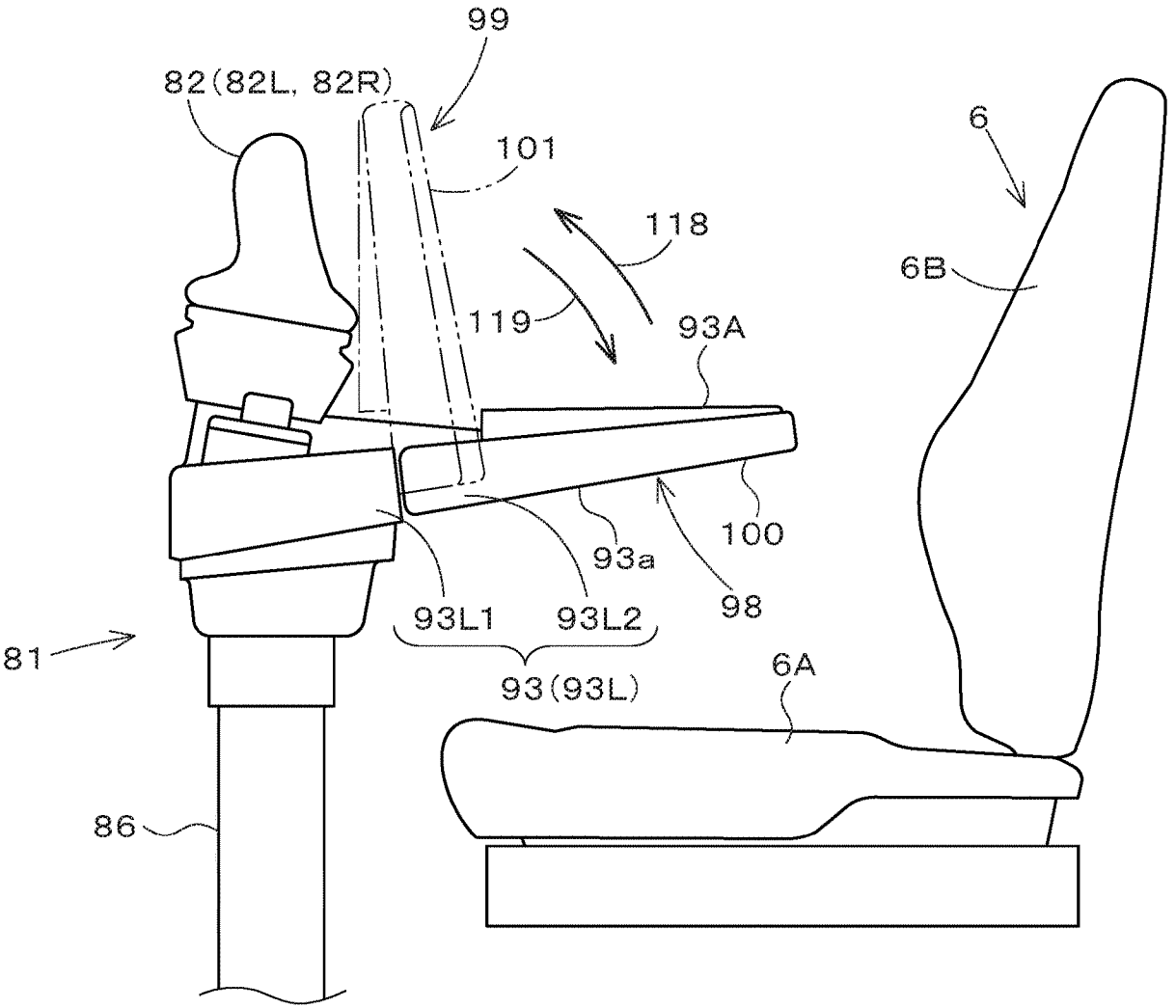
FIG. 9 is a side view of the operation section.
Figure 27:
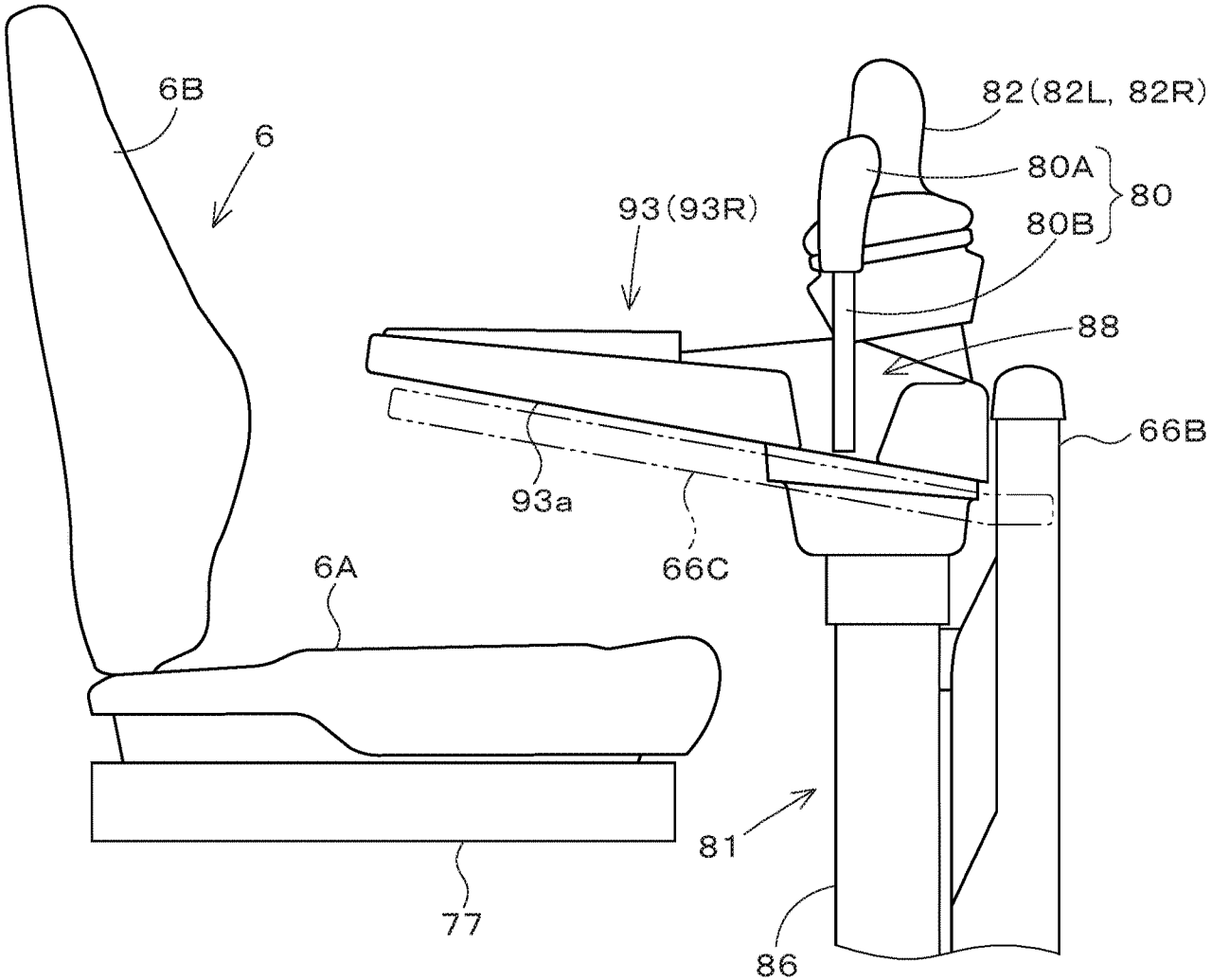
FIG. 27 is a right side view of the operation section.

As shown in FIGS. 9 and 27, a lower surface 93*a* of each armrest 93 (the first armrest 93L and the second armrest 93R) is an inclined surface extending upward toward the rear. Therefore, a lower space below each armrest 93 can be made wide toward the operator's seat 6. At the operation section 42 of the present embodiment, the left leg of the operator is disposed below the first armrest 93L, and the right leg of the operator is disposed below the second armrest 93R. The lower surface 93*a* of each armrest 93, by being an inclined surface extending upward toward the rear, can widen the space where the operator places his/her legs.

As shown in FIGS. 4 and 5, the armrest body 93L2 and the armrest body 93R2 each have an elbow placement portion 93A that is disposed on a rear portion thereof and upon which an elbow is placed. Each elbow placement portion 93A is, for example, a cushion member. An operator places the elbow of his/her left arm on the elbow placement portion 93A of the first armrest 93L and grasps the first manipulator handle 82L with his/her left hand, and places the elbow of his/her right arm on the elbow placement portion 93A of the second armrest 93R and grasps the second manipulator handle 82R with his/her right hand. Therefore, the operator seated on the operator's seat 6 operates the manipulator members 82 with his/her upper body in a forwardly tilted posture.

As shown in FIG. 5, it can be said that the manipulator base body 87 includes a first structural body 87A that includes the attaching portion 92, the armrest base 93L1 of the first armrest 93L, and the second armrest 93R, and a second structural body 87B that includes the armrest body 93L2 of the first armrest 93L.

Figure 7:
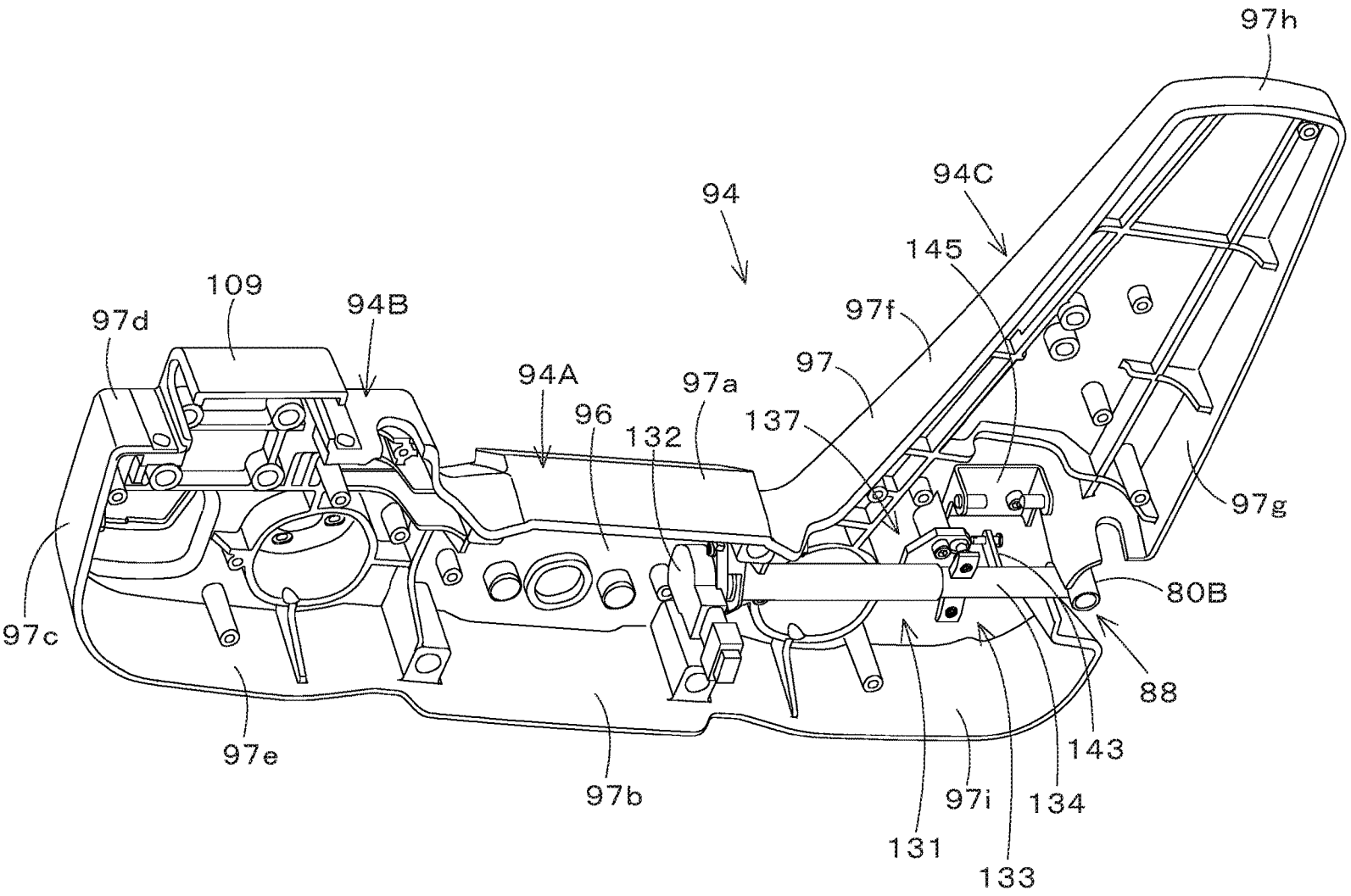
FIG. 7 is a perspective view of a first structural body when seen from therebelow.

As shown in FIG. 6, the first structural body 87A has an upper body 94 and a lower body 95. As shown in FIG. 7, the upper body 94 has an upper wall 96 and a peripheral wall 97 extending downward from an edge portion of the upper wall 96, and has an opening on a lower side thereof. The upper body 94 includes a structural part (called a first structural part) 94A constituting the attaching portion 92, a structural part (called a second structural part) 94B constituting the armrest base 93L1 of the first armrest 93L, and a structural part (called a third structural part) 94C constituting the second armrest 93R.

As shown in FIG. 6, the upper wall 96 is provided with first attaching parts 96A to which the manipulator members 82 are attached, a second attaching part 96B to which the monitor 84 is attached, a third attaching part 96C to which the first switch 84B, the second switch 84C, and the third switch 84D are attached, and a fourth attaching part 96D to which the first operation tool 44A, the second operation tool 44B, and the third operation tool 44C are attached.

As shown in FIG. 7, the peripheral wall 97 has a first wall 97*a* to a ninth wall 97*i*. The first wall 97*a* constitutes a front portion of the first structural part 94A, and the second wall 97*b* constitutes a rear portion of the first structural part 94A. The third wall 97*c* constitutes a left portion of the second structural part 94B, the fourth wall 97*d* constitutes a front portion of the second structural part 94B, and the fifth wall 97*e* constitutes a rear portion of the second structural part 94B. The sixth wall 97*f* constitutes a left portion of the third structural part 94C, the seventh wall 97*g* constitutes a right portion of the third structural part 94C, the eighth wall 97*h* constitutes a front portion of the third structural part 94C, and the ninth wall 97*i* constitutes a rear portion of the third structural part 94C.

Figure 8:
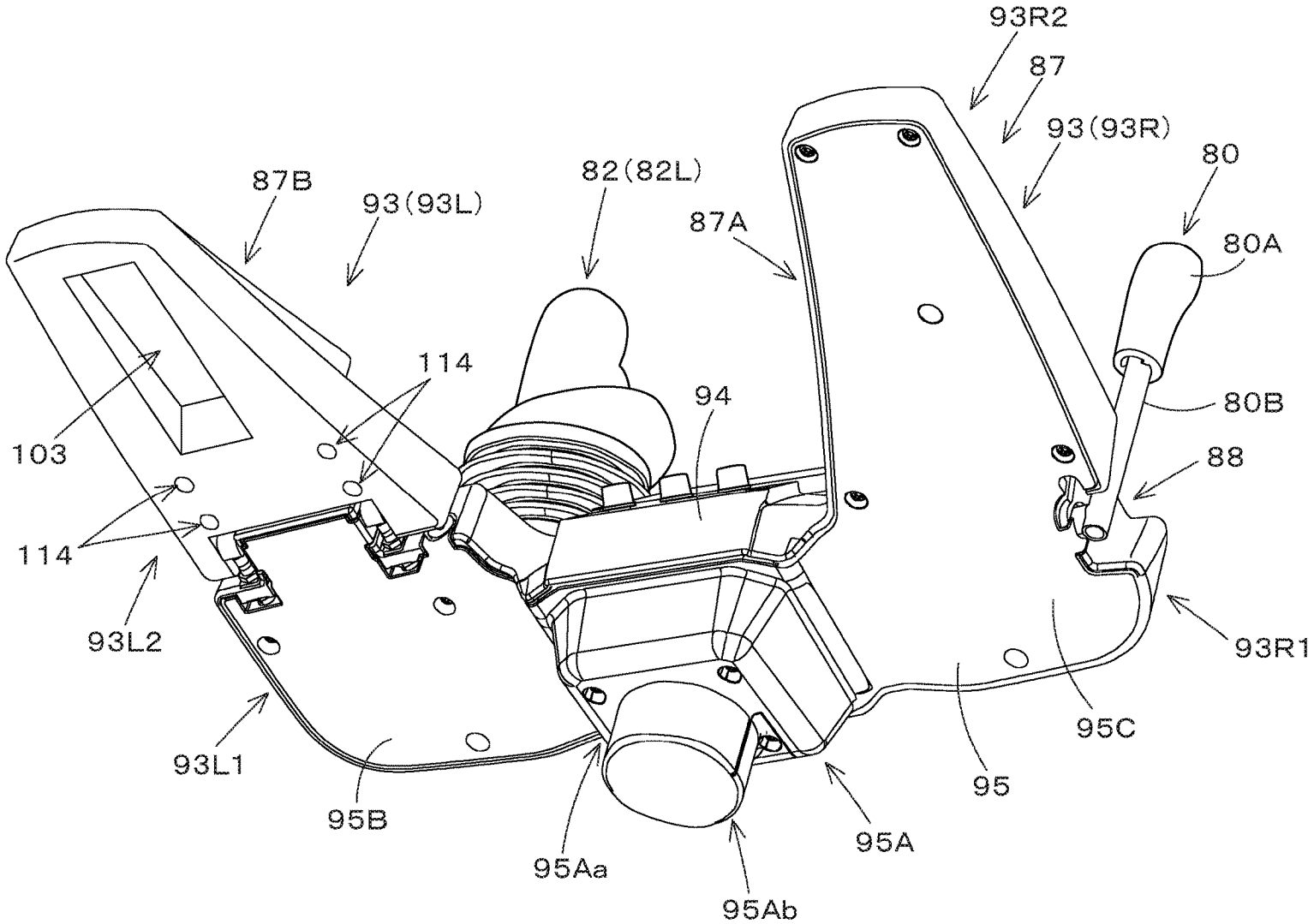
FIG. 8 is a perspective view of the manipulator base body when seen from therebelow.

As shown in FIG. 8, the lower body 95 is a cover body that closes the lower-end opening of the upper body 94. The first structural body 87A has a hollow as a result of covering an inner space (lower space) of the upper body 94 by the lower body 95 from therebelow. That is, the attaching portion 92, the first armrest 93L, and the second armrest 93R have a hollow.

The lower body 95 has a first part 95A corresponding to the first structural part 94A, a second part 95B corresponding to the second structural part 94B, and a third part 95C corresponding to the third structural part 94C.

As shown in FIG. 8, the first part 95A protrudes downward from a lower end of the upper body 94, and covers the attaching bracket 91 of the base portion 86. As shown in FIG. 6, the first part 95A has a main part 95Aa that is integrally formed with the second part 95B and the third part 95C and that covers the left and right sides, the rear, and the bottom of the attaching bracket 91, and a sub-part 95Ab that covers the front of the attaching bracket 91. By removing the sub-part 95Ab, it is possible to remove the main part 95Aa (lower body 95) with the upper body 94 being attached to the base portion 86.

As shown in FIG. 9, the first armrest 93L (armrest 93) is switchable between a first orientation 98 and a second orientation 99. The first orientation 98 is an orientation in which an operator is prevented from sitting on and getting off the operator's seat 6. Specifically, the first orientation 98 is an orientation in which an operator is prevented from sitting on and getting off the operator's seat 6 through a sitting-on and getting-off passage between the operator's seat 6 and the doorway 62. The second orientation 99 is an orientation in which an operator is allowed to sit on and get off the operator's seat. Specifically, the second orientation 99 is an orientation in which an operator is allowed to sit on and get off the operator's seat 6 through the sitting-on and getting-off passage between the operator's seat 6 and the doorway 62.

In the present embodiment, the armrest body 93L2 of the first armrest 93L can change its position between a lowered position 100, where the armrest body 93L2 extends toward the operator's seat 6 from the armrest base 93L1 as shown by a solid line in FIG. 9, and a raised position 101, where the armrest body 93L2 is rotated upward from the lowered position 100 by an angle of substantially 90 degrees as shown by alternate long and two short dash lines in FIG. 9. The first orientation 98 is realized by setting the armrest body 93L2 of the first armrest 93L in the lowered position 100, and the second orientation 99 is realized by setting the armrest body 93L2 of the first armrest 93L in the raised position 101.

In the first orientation 98, operation objects (the boom cylinder C3, the arm cylinder C4, the bucket cylinder C5, the turn motor M3) that are operated by the manipulator member 82 are allowed to operate, and, in the second orientation 99, the operations of the operation objects are prevented from being performed. Note that hydraulic actuators whose operations are allowed to be performed and prevented from being performed as a result of switching the orientation of the first armrest 93L between the first orientation 98 and the second orientation 99 are not limited to only the boom cylinder C3, the arm cylinder C4, the bucket cylinder C5, and the turn motor M3. Other hydraulic actuators (the first travel motor M1, the second travel motor M2, the swing cylinder C2, the dozer cylinder, etc.) may be added. That is, when the first armrest 93L is set in the first orientation 98, the operations of the hydraulic actuators mounted at the working machine 1 are allowed to be performed, whereas, when the first armrest 93L is set in the second orientation 99, the operations of the hydraulic actuators mounted at the working machine 1 are prevented from being performed.

"The operations of the hydraulic actuators are allowed to be performed" means that, when members that operate the hydraulic actuators are operated, the controller U1 controls the electric current that is supplied to the corresponding control valve units (or sends signals to the corresponding control valve units), and thus the hydraulic actuators are in an operating state. "The operations of the hydraulic actuators are prevented from being performed" means that, even if the members that operate the hydraulic actuators are operated, the controller U1 does not send signals to the corresponding control valve units and thus the hydraulic actuators are in a non-operating state.

Figure 10:
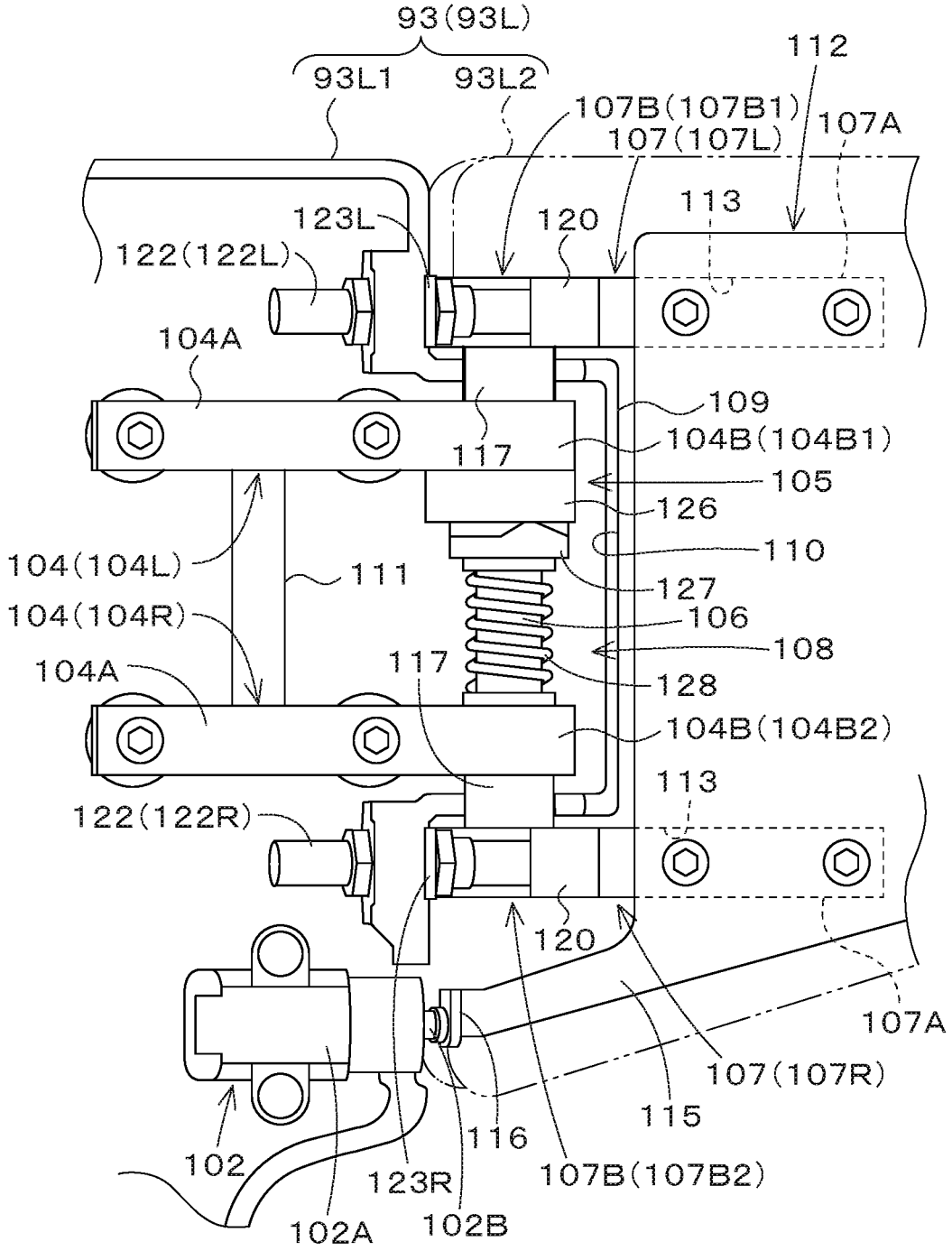
FIG. 10 is a bottom view of a hinge mechanism.
Figure 11:
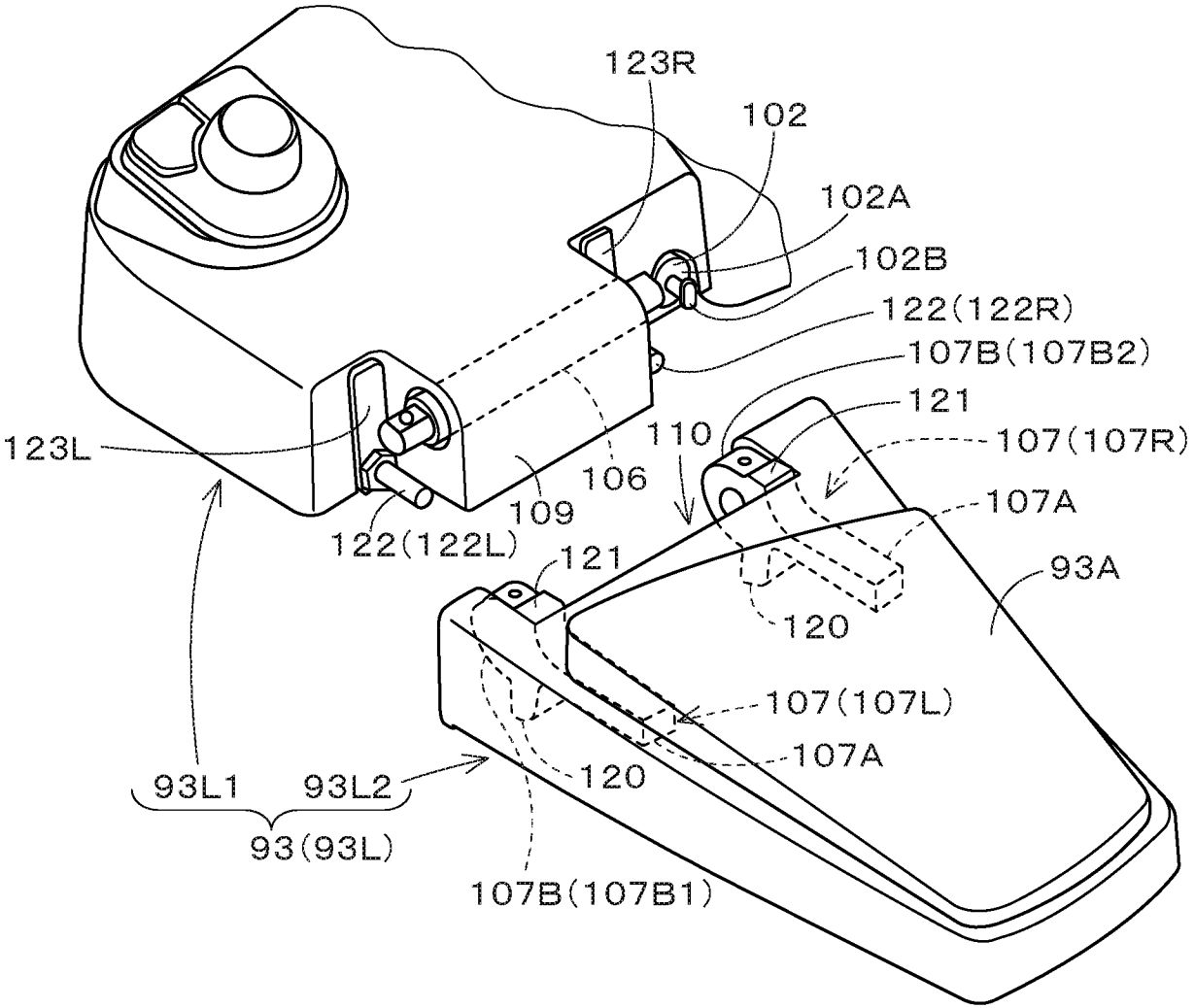
FIG. 11 is an exploded perspective view of a first armrest.

The position of the armrest body 93L2 is detected by a detection switch 102. As shown in FIGS. 10 and 11, the detection switch 102 is provided on the armrest base 93L1. Specifically, the detection switch 102 has a switch body 102A that is accommodated in a rear-end-side right portion of the armrest base 93L1 and that is attached to the armrest base 93L1, and a contactor 102B that protrudes rearward from the armrest base 93L1.

In detecting the position of the armrest body 93L2, when the armrest body 93L2 is positioned in the lowered position 100, the armrest body 93L2 contacts (pushes) the contactor 102B to detect that the armrest body 93L2 is in the lowered position 100. When the armrest body 93L2 is rotated toward the raised position 101 from the lowered position 100, and the armrest body 93L2 is separated from the contactor 102B, it is detected that the armrest body is not in the lowered position 100, that is, the armrest body is in the raised position 101.

The switch body 102A is connected to the controller U1. The controller U1 is capable of acquiring detection information provided by the detection switch 102. When the controller U1 acquires information that the armrest body 93L2 is in the lowered position 100, the controller U1 allows the operations of the hydraulic actuators mounted at the working machine 1 to be performed, whereas, when the controller U1 acquires information that the armrest body 93L2 is not in the lowered position 100 (is in the raised position 101), the controller U1 prevents the operations of the hydraulic actuators mounted at the working machine 1 to be performed.

Note that, with the armrest body 93L2 being detected as being in the lowered position 100, the operations of the hydraulic actuators mounted at the working machine 1 may be prevented from being performed by pushing a switch provided at the working machine 1, such as the second switch 84C.

Note that, with the armrest body being detected as being in the raised position 101, the operations of the hydraulic actuators may be allowed by stopping the controller U1 from preventing the operations of the hydraulic actuators mounted at the working machine 1 as a result of pushing a switch provided at the working machine 1, such as the second switch 84C.

As shown in FIG. 8, a recessed portion 103 is formed on a lower-surface side of the armrest body 93L2 of the first armrest 93L. As a result of forming the recessed portion 103, it is possible to catch the recessed portion 103 with one's finger or the like when, for example, raising the armrest body from the lowered position 100.

As shown in FIG. 10, a hinge mechanism 105 that supports the armrest body 93L2 so as to be rotatable around the armrest base 93L1 is installed in the first armrest 93L.

Figure 12:
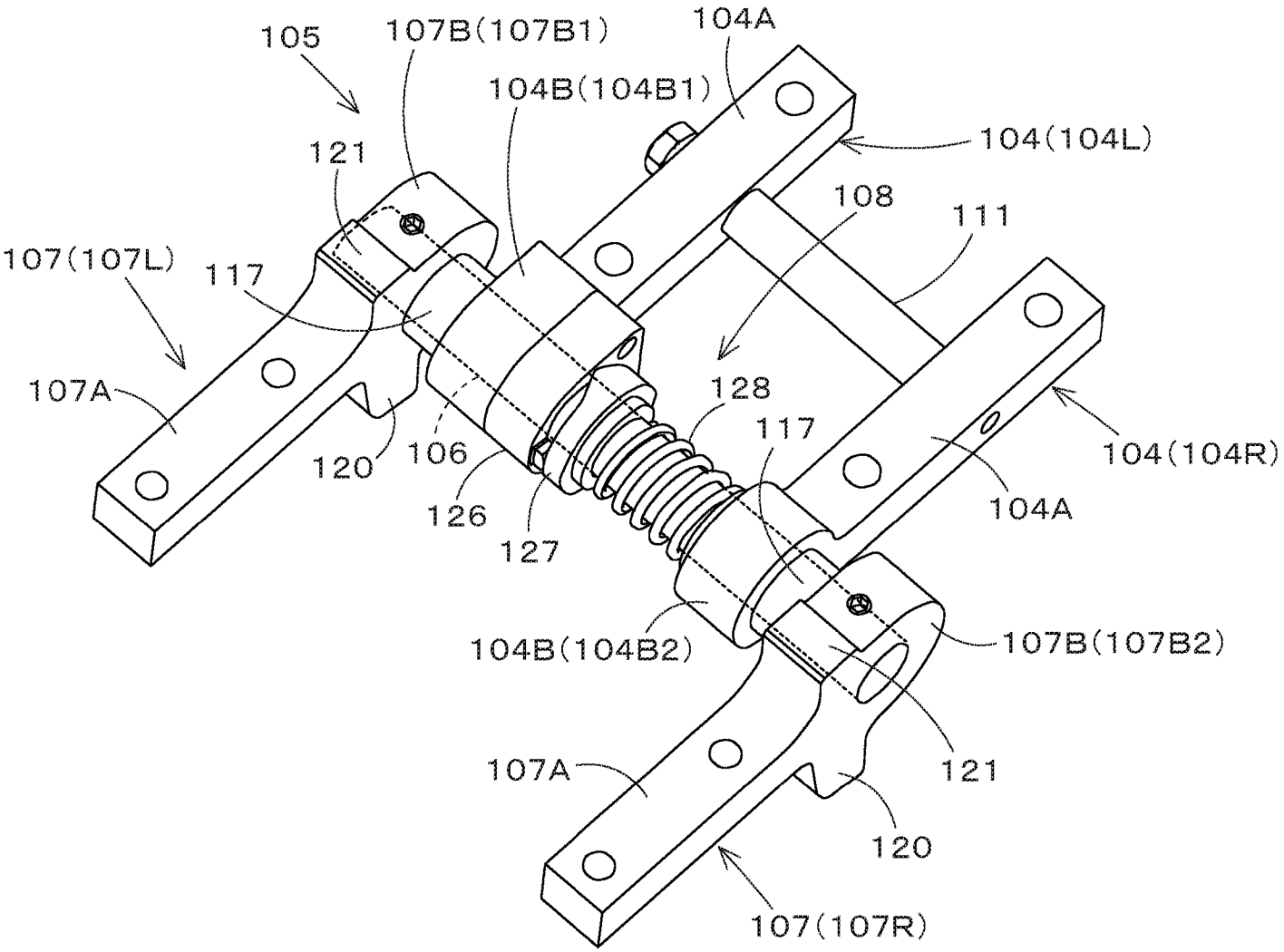
FIG. 12 is a perspective view of the hinge mechanism when seen from thereabove.

As shown in FIGS. 10 and 12, the hinge mechanism 105 has a fixed-side member 104, a shaft 106, a moving-side member 107, and a holding mechanism 108.

As shown in FIGS. 10 and 11, a protrusion 109 protruding rearward is formed at the rear portion of the armrest base 93L1 (the second structural body 94B), and a recessed portion 110 into which the protrusion 109 is inserted is formed in a front portion of the armrest body. The hinge mechanism 105 is installed at a joint between the rear portion of the armrest base 93L1 and the front portion of the armrest body 93L2.

As shown in FIGS. 10 and 12, the fixed-side member 104 is accommodated in the rear portion of the armrest base 93L1 (the second structural part 94B). The fixed-side member 104 includes a pair of fixed hinges (a first fixed hinge 104L and a second fixed hinge 104R) disposed side by side with an interval therebetween in the machine-body width direction K2. The first fixed hinge 104L and the second fixed hinge 104R each have a fixed portion 104A that is attached to the armrest base 93L1 through, for example, a bolt, and a supporting portion 104B (a first supporting portion 104B1 or a second supporting portion 104B2) that is provided on a rear portion of the fixed portion 104A. The first supporting portion 104B1 is disposed on the left side within the protrusion 109, and the second supporting portion 104B2 is disposed on the right side within the protrusion 109. The fixed portion 104A of the first fixed hinge 104L and the fixed portion 104A of the second fixed hinge 104R are connected to each other by a connection member 111.

The shaft 106 is supported by the fixed-side member 104 and rotates together with the armrest body 93L2. The shaft 106 is inserted from the first supporting portion 104B1 to the second supporting portion 104B2 so as to be rotatable around an axis. That is, the first supporting portion 104B1 supports one end of the shaft 106 in an axial direction, and the second supporting portion 104B2 supports the other end of the shaft 106 in the axial direction. The shaft 106 protrudes from the first supporting portion 104B1 and leftwards from the protrusion 109, and protrudes from the second supporting portion 104B2 and rightwards from the protrusion 109.

As shown in FIGS. 10 and 11, the moving-side member 107 rotates together with the shaft 106 and is attached to the armrest body 93L2. The moving-side member 107 includes a pair of movable hinges (a first movable hinge 107L and a second movable hinge 107R) that are disposed side by side with an interval in the machine-body width direction K2 therebetween, and are attached, one on the left and the other on the right of a front portion of the armrest body 93L2. The first movable hinge 107L and the second movable hinge 107R each have a fixed portion 107A that is attached to the armrest body 93L2, and a shaft attaching portion 107B (a first shaft attaching portion 107B1 or a second shaft attaching portion 107B2) that is provided at a front portion of the fixed portion 107A.

Figure 13:
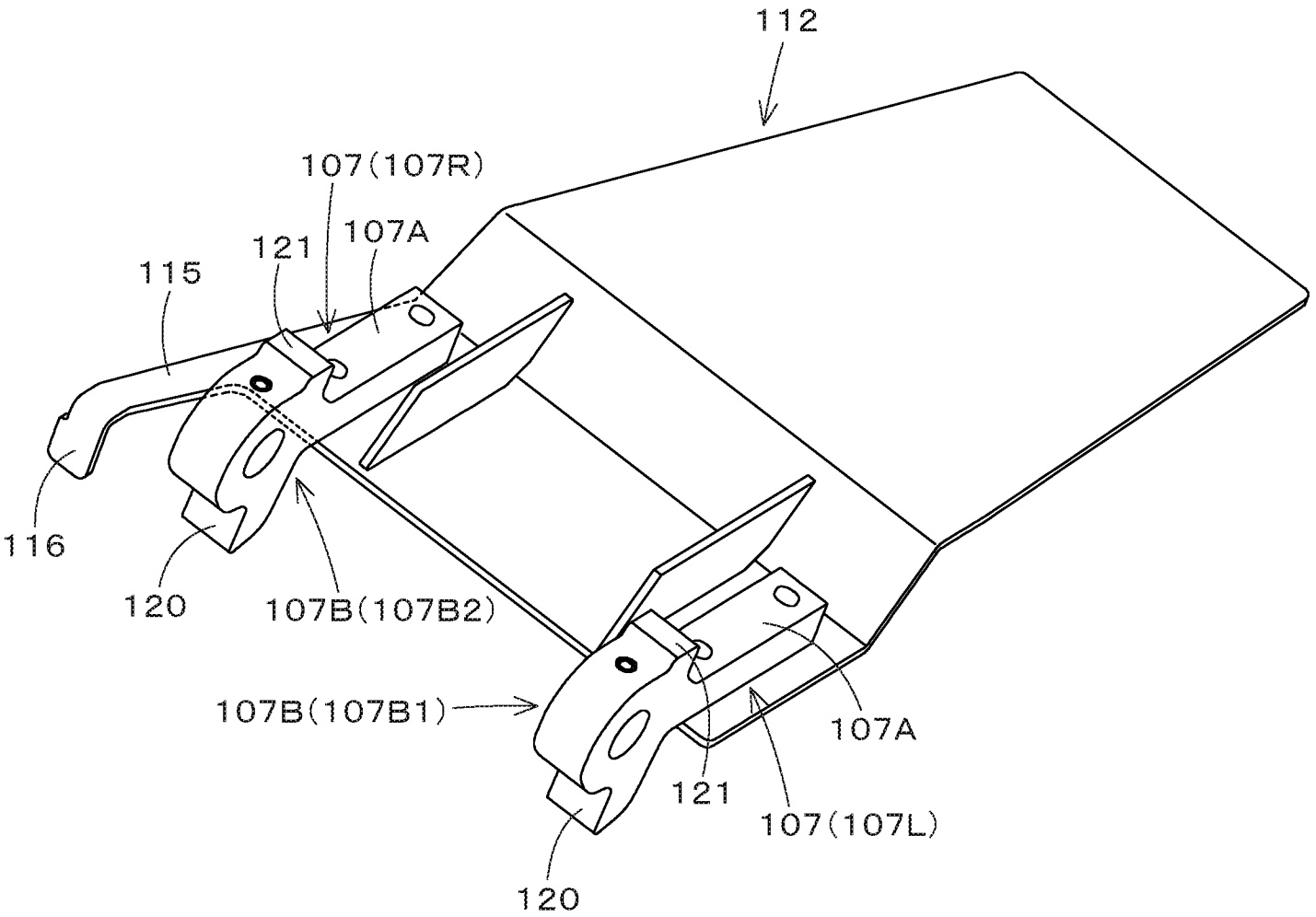
FIG. 13 shows a core and moving-side members.

As shown in FIG. 13, the moving-side member 107 (the fixed portions 107A) is attached to a core 112, formed from a plate material, through, for example, bolts. The core 112 is the core 112 of the armrest body 93L2, and, as shown in FIG. 10, is embedded in the armrest body 93L2. The armrest body 93L2 has insertion portions 113 (see FIG. 10) into which the fixed portions 107A of the moving-side member 107 are inserted, and bolt insertion holes 114 (see FIG. 8) into which bolts are inserted. The fixed portions 107A of the moving-side member 107 (the first movable hinge 107L and the second movable hinge 107R) are inserted into the armrest body 93L2, and the fixed portions 107A are fixed to the core 112 by bolts that are inserted through the bolt insertion holes 114, as a result of which the moving-side member 107 is attached to the core 112.

As shown in FIG. 13, the core 112 has an extending portion 115 extending forward from a right end of the core 112, and a striking portion 116 provided at a front portion of the extending portion 115. When the armrest body 93L2 is brought to the lowered position 100, the striking portion 116 directly contacts the contactor 102B of the detection switch 102 or contacts the contactor 102B of the detection switch 102 through a resin member constituting the armrest body 93L2.

As shown in FIG. 11, the first shaft attaching portion 107B1 is disposed on a left side inside the recessed portion 110 of the armrest body 93L2, and the second shaft attaching portion 107B2 is disposed on a right side inside the recessed portion 110. As shown in FIG. 12, the first shaft attaching portion 107B1 is attached to a left end of the shaft 106 so as to be rotatable together with the shaft 106, and the second shaft attaching portion 107B2 is attached to a right end of the shaft 106 so as to be rotatable together with the shaft 106.

Note that the first movable hinge 107L and the second movable hinge 107R are first installed on the shaft 106, and, after being installed on the shaft 106, are attached to the armrest body 93L2. As shown in FIGS. 10 and 12, a spacer 117 is interposed between the first supporting portion 104B1 and the first shaft attaching portion 107B1, and a spacer 117 is interposed between the second supporting portion 104B2 and the second shaft attaching portion 107B2.

As described above, the armrest body 93L2 is rotatable around the shaft 106 with respect to the armrest base 93L1 in a raising direction 118 (see FIG. 9), which is a direction in which the armrest body 93L2 is rotated from the lowered position 100 to the raised position 101, and in a lowering direction 119 (see FIG. 9), which is a direction in which the armrest body 93L2 is rotated from the raised position 101 to the lowered position 100. That is, the armrest body 93L2 is switched between the lowered position 100 and the raised position 101 by being rotated around the shaft 106.

As shown in FIG. 12, the first shaft attaching portion 107B1 and the second shaft attaching portion 107B2 are each provided with a first contacting portion (damper contacting portion) 120 and a second contacting portion 121. As shown in FIG. 11, when the armrest body 93L2 is in the lowered position 100, each first contacting portion 120 is positioned at a lower portion of a corresponding one of the first shaft attaching portion 107B1 and the second shaft attaching portion 107B2, and each second contacting portion 121 is positioned at an upper portion of the corresponding one of the first shaft attaching portion 107B1 and the second shaft attaching portion 107B2.

As shown in FIGS. 10 and 11, the armrest base 93L1 is provided with at least one damper 122 that, when the armrest body 93L2 switches from the raised position 101 to the lowered position 100, contacts the armrest body 93L2 to reduce (decrease) absorption of shock produced when the armrest body 93L2 rotates from the raised position 101 to the lowered position 100. As the at least one damper 122, for example, a hydraulic damper is used. The at least one damper 122 is a pair of dampers (a first damper 122L and a second damper 122R). The first damper 122L is disposed on the left of the protrusion 109, and the second damper 122R is disposed on the right of the protrusion 109. A first abutment member 123L is provided at a portion where the first damper 122L is provided, and a second abutment member 123R is provided at a portion where the second damper 122R is provided.

Figure 14:
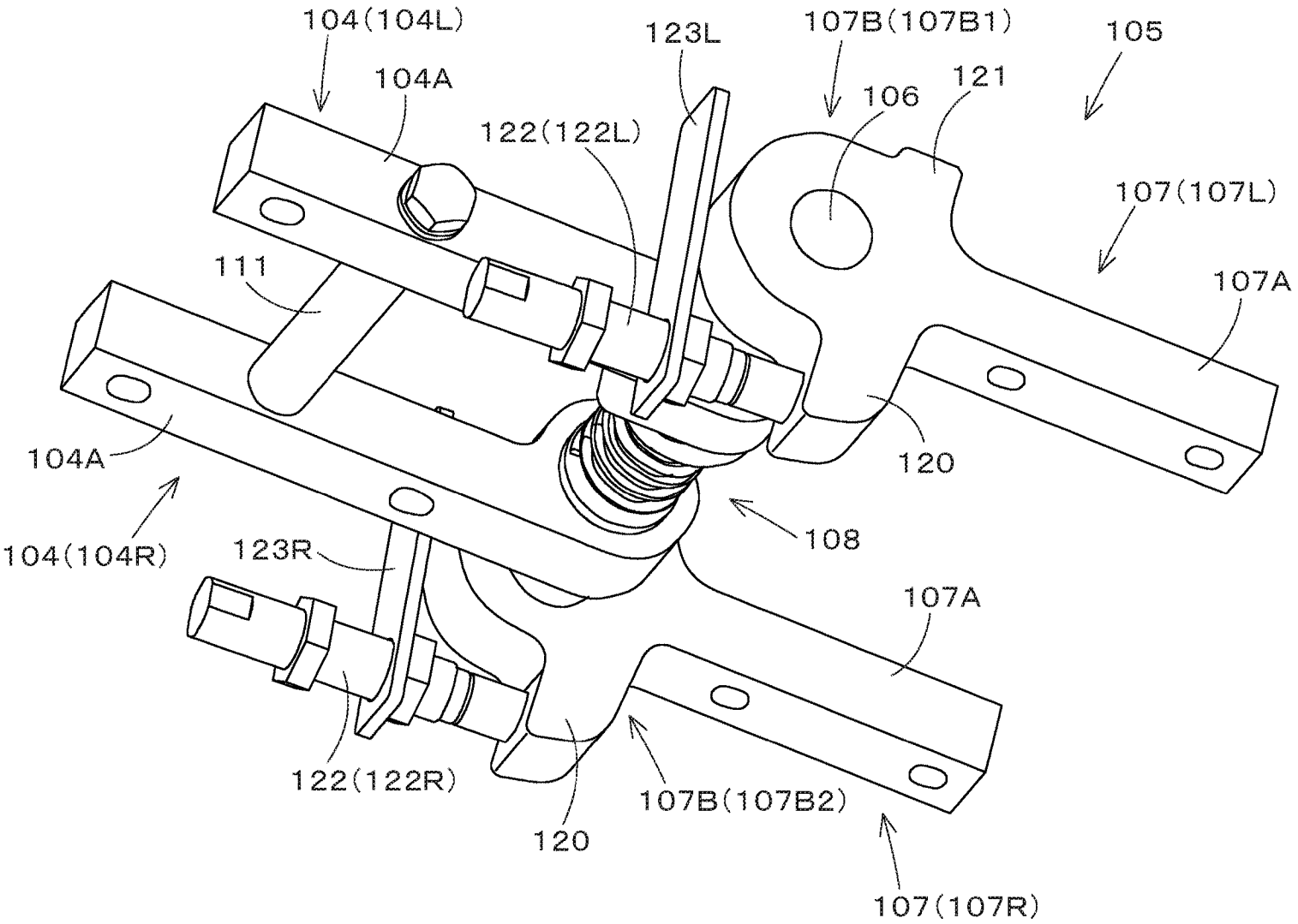
FIG. 14 is a perspective view showing a state in which the moving-side members contact dampers.

As shown in FIG. 14, when the armrest body 93L2 is in the lowered position 100, the first contacting portion 120 of the first shaft attaching portion 107B1 contacts the first damper 122L, and the first contacting portion 120 of the second shaft attaching portion 107B2 contacts the second damper 122R.

Figure 15:
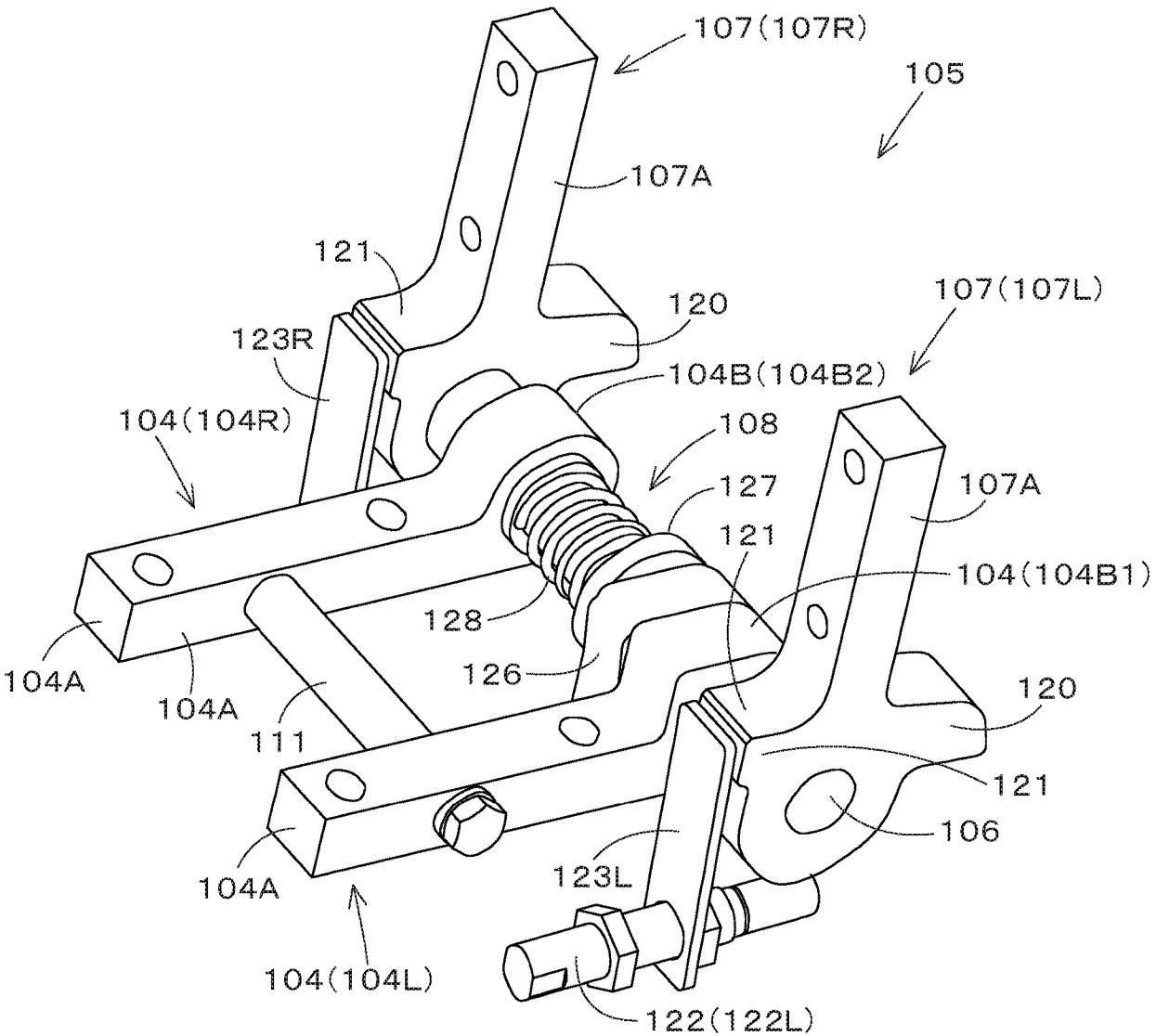
FIG. 15 is a perspective view showing a state in which the moving-side members contact abutment members.

As shown in FIG. 15, when the armrest body 93L2 is in the raised position 101, the second contacting portion 121 of the first shaft attaching portion 107B1 contacts the first abutment member 123L, and the second contacting portion 121 of the second shaft attaching portion 107B2 contacts the second abutment member 123R.

Note that dampers 122 may be provided at the armrest body 93L2. In this case, when the armrest body 93L2 is switched to the lowered position 100, the dampers 122 contact the armrest base 93L1. Note that dampers 122 need not be provided, or may not be provided. Instead of dampers 122, cushion members may be used as stoppers.

The holding mechanism 108 is a mechanism that holds the armrest body 93L2 in the lowered position 100 and the raised position 101. As shown in FIGS. 10 and 12, the holding mechanism 108 is installed compactly between the first supporting portion 104B1 and the second supporting portion 104B2. The holding mechanism 108 has a first cam (first member) 126 that is attached to the fixed-side member 104, a second cam (second member) 127 that is supported so as to be rotatable together with the shaft 106 and to be swingable in an axial direction, and a spring member 128 that pushes the second cam 127 against the first cam 126.

The first cam 126 is disposed on the right of the first supporting portion 104B1, and is fitted around the shaft 106 (is inserted onto the shaft 106) and is fixed to the first supporting portion 104B1 by, for example, a bolt.

The second cam 127 is disposed on the right of the first cam 126, and is fitted around the shaft 106 so as to be swingable in an axial direction and rotatable together with the shaft 106.

The spring member 128 includes a compression coil spring, and is fitted around an outer periphery of the shaft 106 at a location between the second cam 127 and the second supporting portion 104B2. The spring member 128 has an axis in a direction that is the same as the direction of an axis of the shaft 106, and is interposed in a compressed state between the second cam 127 and the second supporting portion 104B2. Therefore, a biasing force of the spring member 128 acts in a direction in which the second cam 127 is pushed against the first cam 126. The second cam 127 is pushed against the first cam 126 to generate a force that holds the armrest body 93L2 in the raised position 101 or the lowered position, and a force that holds the first armrest 93L to prevent shaking of the first armrest 93L between the lowered position 100 and the raised position 101 and between the lowered position 100 and the raised position 101.

Figure 16:
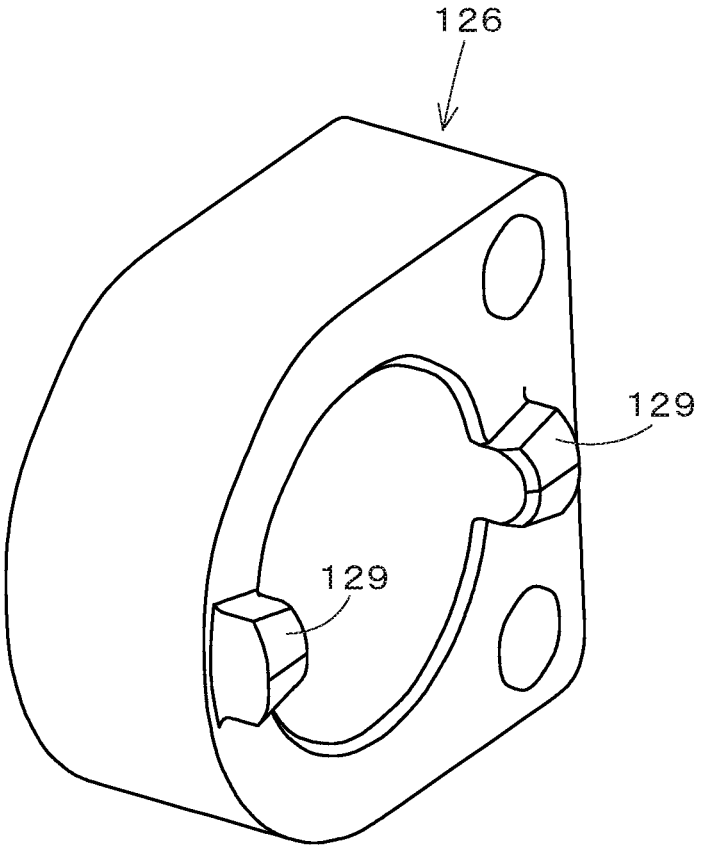
FIG. 16 is a perspective view of a first cam.

As shown in FIG. 16, at least one cam protrusion 129 protruding toward the second cam 127 is formed on a surface of the first cam 126 opposite to the second cam 127. The at least one cam protrusion 129 is a pair of cam protrusions 129. The pair of cam protrusions 129 are disposed at positions that are symmetrical to each other with the shaft 106 therebetween (positions that are symmetrical in a radial direction of the shaft 106).

Figure 17:
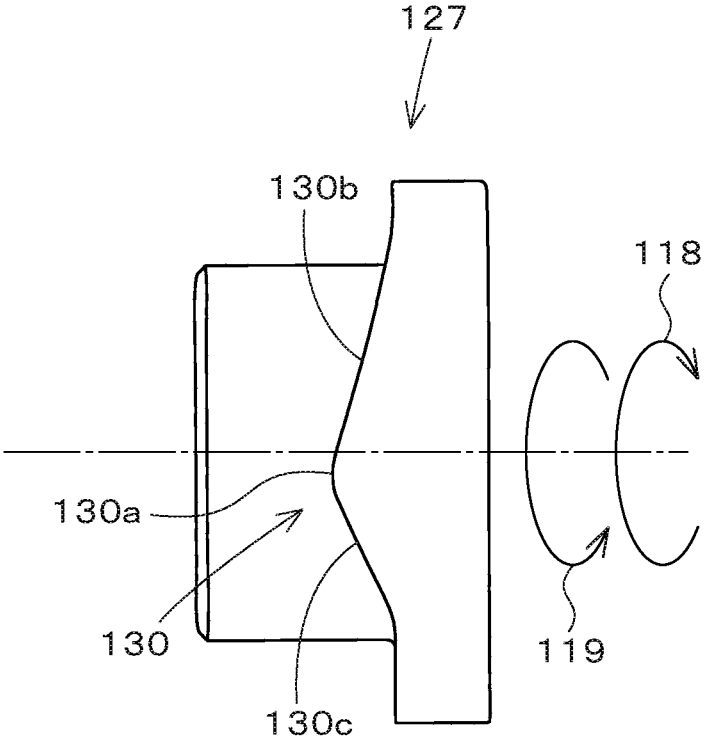
FIG. 17 is a plan view of a second cam.

As shown in FIG. 17, at least one cam inclined surface 130 that contacts the cam protrusions 129 is provided on a surface of the second cam 127 opposite to the first cam 126. The at least one cam inclined surface 130 is a pair of cam inclined surfaces in correspondence with the pair of cam protrusions 129. Each cam inclined surface 130 has an apex portion 130*a* that is closest to the first cam 126, and a first inclined surface 130*b* and a second inclined surface 130*c* that are formed on respective sides of the apex portion 130*a*, the first inclined surface 130*b* existing in the raising direction 118 with respect to the apex portion 130*a*, the second inclined surface 130*c* existing in the lowering direction 119 with respect to the apex portion 130*a*.

Figure 18:
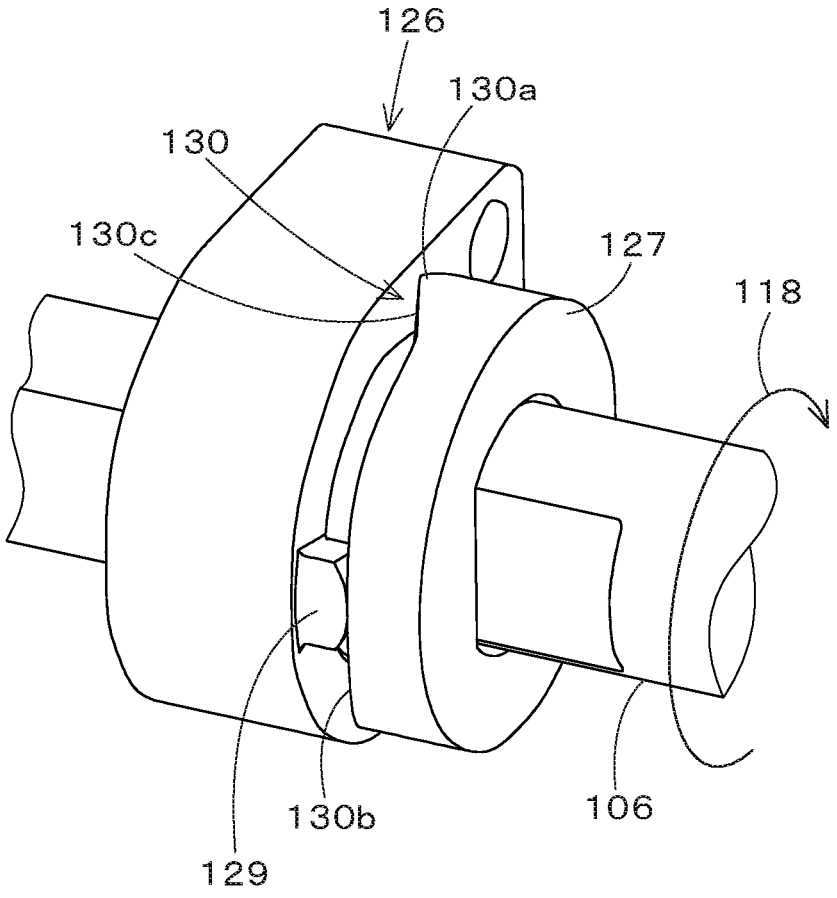
FIG. 18 is a perspective view showing the first cam and the second cam in a lowered position.

FIG. 18 shows a state in which the armrest body 93L2 exists in the lowered position 100. When the armrest body 93L2 is rotated from the lowered position 100 to the raised position 101, the cam protrusions 129 contact the first inclined surfaces 130*b* and move over the apex portions 130*a* to contact the second inclined surfaces 130*c*.

Figure 19:
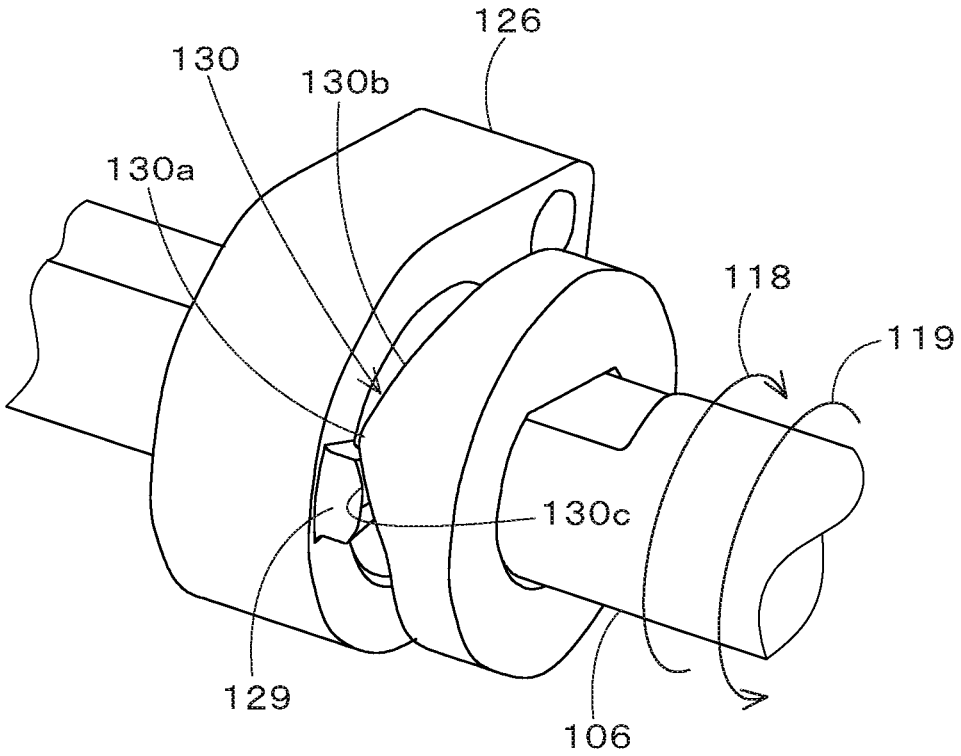
FIG. 19 is a perspective view showing the first cam and the second cam in a raised position.

As shown in FIG. 19, when the armrest body 93L2 exists in the raised position 101, the cam protrusions 129 contact the second inclined surfaces 130*c*, and a biasing force of the spring member 128 acts to rotate the armrest body 93L2 in the raising direction 118. In order to rotate the armrest body 93L2 in the lowering direction 119 from the raised position 101, unless the cam protrusions 129 compress the spring member 128 and move over the apex portions 130*a* of the cam inclined surfaces 130, the armrest body 93L2 is not lowered. Therefore, the armrest body 93L2 is held in the raised position 101.

As a result of the cam protrusions 129 contacting the first inclined surfaces 130*b*, a force that assists in the rotation of the armrest body 93L2 in the lowering direction 119 is generated, and as a result of the cam protrusions 129 contacting the second inclined surfaces 130*c*, a force that assists in the rotation of the armrest body 93L2 in the raising direction 118 is generated. That is, the cam protrusions 129 and the cam inclined surfaces 130 contact each other to cause a biasing force of the spring member 128 to act in a direction that assists in the rotation of the armrest body 93L2 such that, on a lowered-position-100 side from an intermediate position between the lowered position 100 and the raised position 101, the armrest body 93L2 is rotated to the lowered position 100 and such that, on a raised-position-101 side from the intermediate position, the armrest body 93L2 is rotated to the raised position 101.

In the holding mechanism 108 of the present embodiment, since the first cam 126, the second cam 127, and the spring member 128 are installed on the shaft 106 (on the same axis), the holding mechanism 108 can be compactly formed, and can be compactly accommodated within the thickness of the armrest 93 in an up-down direction.

Note that the cam protrusions 129 may be formed on the second cam 127, and the cam inclined surfaces 130 may be formed on the first cam 126.

Figure 20:
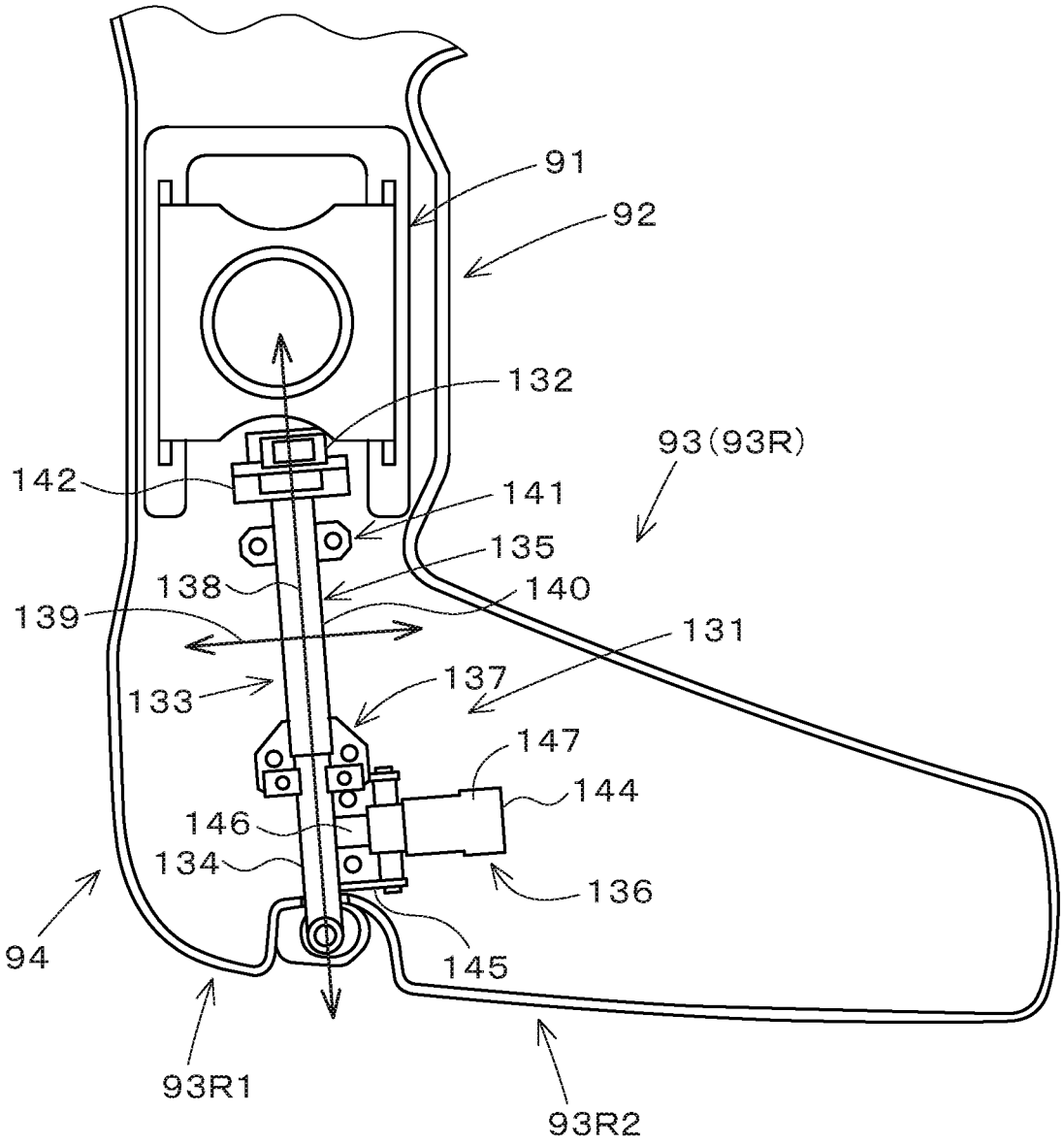
FIG. 20 is a bottom view of the inside of a second armrest when seen from therebelow.
Figure 21:
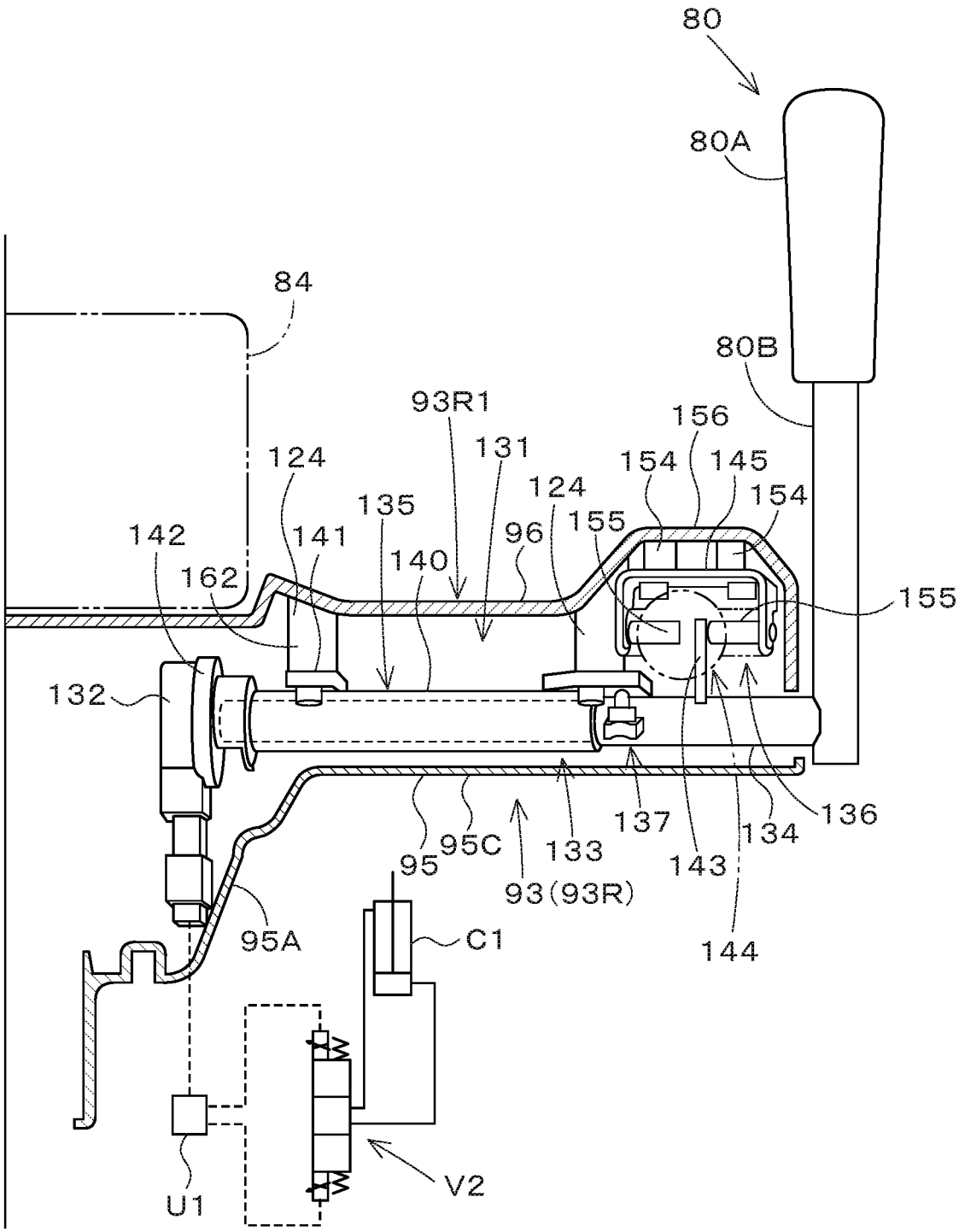
FIG. 21 is a back sectional view of a supporting structure of a dozer lever.

As shown in FIGS. 20 and 21, a manipulator mechanism 131 is installed at the second armrest 93R. The manipulator mechanism 131 is a mechanism that manipulates the dozer device 7. The manipulator mechanism 131 includes the dozer lever (operation member) 80, an angle sensor 132 that detects an operation direction (direction in which the dozer lever 80 is swung) and an operation amount (degree of swinging) of the dozer lever 80, and an operation supporting mechanism 133 that supports the dozer lever 80.

As shown in FIG. 5, the dozer lever 80 is disposed opposite to the attaching portion 92 at the armrest base 93R1 of the second armrest 93R. That is, the dozer lever 80 is disposed on the right of the manipulator base body 87 (the armrest base 93R1 of the second armrest 93R). A recess provided portion 88 that is recessed toward the right and left is formed at the right side of the armrest base 93R1. The dozer lever 80 has a grip 80A that is grasped by an operator, and a lever shaft 80B on whose upper portion the grip 80A is attached. The dozer lever 80 is disposed at a right portion of the manipulator base body 87 by inserting a lower portion of the lever shaft 80B into the recess provided portion 88 from the right. The dozer lever 80 can be swung in a front-rear direction around a lower portion thereof from a neutral position where the lever shaft 80B extends in an up-down direction. As a result of swinging the dozer lever 80 forward from the neutral position, the dozer device 7 (dozer blade 7B) moves downward, and as a result of swinging the dozer lever 80 rearward, the dozer device 7 (dozer blade 7B) moves upward.

As shown in FIG. 21, the angle sensor 132 includes, for example, a potentiometer. The angle sensor 132 is connected to the controller U1. The controller U1 is capable of acquiring detection information (the operation direction and the operation amount of the dozer lever 80) provided by the angle sensor 132. Therefore, a detection signal detected by the angle sensor 132 is sent to the controller U1, and the controller U1 electrically controls a control valve V2 that controls a dozer cylinder C1 on the basis of the detection signal provided by the angle sensor 132.

As shown in FIG. 21, the angle sensor 132 is accommodated in the attaching portion 92 of the manipulator base body 87 (the second structural part 94B of the first structural body 87A). Since the angle sensor 132 is long in an up-down direction, when the angle sensor 132 is accommodated in, for example, the armrest base 93R1 of the second armrest 93R, a portion protruding downward from the lower surface of the second armrest 93R is formed. However, it is possible to prevent a portion protruding downward from the lower surface of the second armrest 93R from being formed by accommodating the angle sensor 132 in the attaching portion 92. That is, the lower surface of the second armrest 93R can be formed with a flat shape.

As shown in FIGS. 20 to 23, the operation supporting mechanism 133 has a rotary shaft 134 that is fixed to the dozer lever 80, a shaft supporting member 135 that supports the rotary shaft 134 so as to be rotatable around an axis, a neutral return mechanism 136 that returns the dozer lever 80 to a neutral position from an post-operation position where the dozer lever 80 is operated, and a swing restricting mechanism 137 that restricts the operation amount of the dozer lever 80 from the neutral position. The operation supporting mechanism 133 is accommodated inside the hollow of the second armrest 93R. In the present embodiment, the operation supporting mechanism 133 is accommodated inside a hollow of the armrest base 93R1 of the second armrest 93R.

As shown in FIGS. 20 and 21, the rotary shaft 134 has an axis extending in a first horizontal direction 138, which is a direction in the machine-body width direction K2, and is disposed below the upper wall 96 of the second armrest 93R (the armrest base 93R1). The rotary shaft 134 is disposed so as to protrude in the machine-body width direction K2 (leftwards) from an end-portion side (one end side in the machine-body width direction K2) at a dozer-lever-80 side of the second armrest 93R (the armrest base 93R1). In the present embodiment, the rotary shaft 134 is disposed so as to cross the second armrest 93R (the armrest base 93R1) in the machine-body width direction K2.

A right end (one end in an axial direction) of the rotary shaft 134 protrudes from the second armrest 93R, and is fixed to a lower end of the lever shaft 80B of the dozer lever 80. The rotary shaft 134 is rotatable around the axis extending in the first horizontal direction 138, and the dozer lever 80 is disposed on the one end (the right end) in the axial direction of the rotary shaft 134, and rotates together with the rotary shaft 134. That is, the rotary shaft 134 rotates around the axis due to the swinging of the dozer lever 80. The other end (the left end) in the axial direction of the rotary shaft 134 engages with a detection shaft of the angle sensor 132. The angle sensor 132 detects the rotation direction and the rotation angle around the axis of the rotary shaft 134. Therefore, the operation direction and the operation amount of the dozer lever 80 are detected.

Note that "direction in the machine-body width direction K2" includes a direction that coincides with the machine-body width direction K2 and a direction that is slightly slanted with respect to the machine-body width direction K2. In the illustrated example (see FIG. 20), the first horizontal direction 138 is slightly slanted in a slanting direction rearward toward the right with respect to the machine-body width direction K2.

As shown in FIGS. 21 to 24, the shaft supporting member 135 has a cylinder member 140 that has an axis extending in the first horizontal direction 138, an attaching stay 141 that is fixed to an upper portion of the cylinder member 140, and a sensor bracket 142 that is fixed to a left end of the cylinder member 140. The cylinder member 140 is concentrically fitted around the left side of the rotary shaft 134 from an intermediate portion of the rotary shaft 134. In other words, a left portion of the rotary shaft 134 is inserted into the cylinder member 140 so as to be rotatable around the axis.

Figure 22:
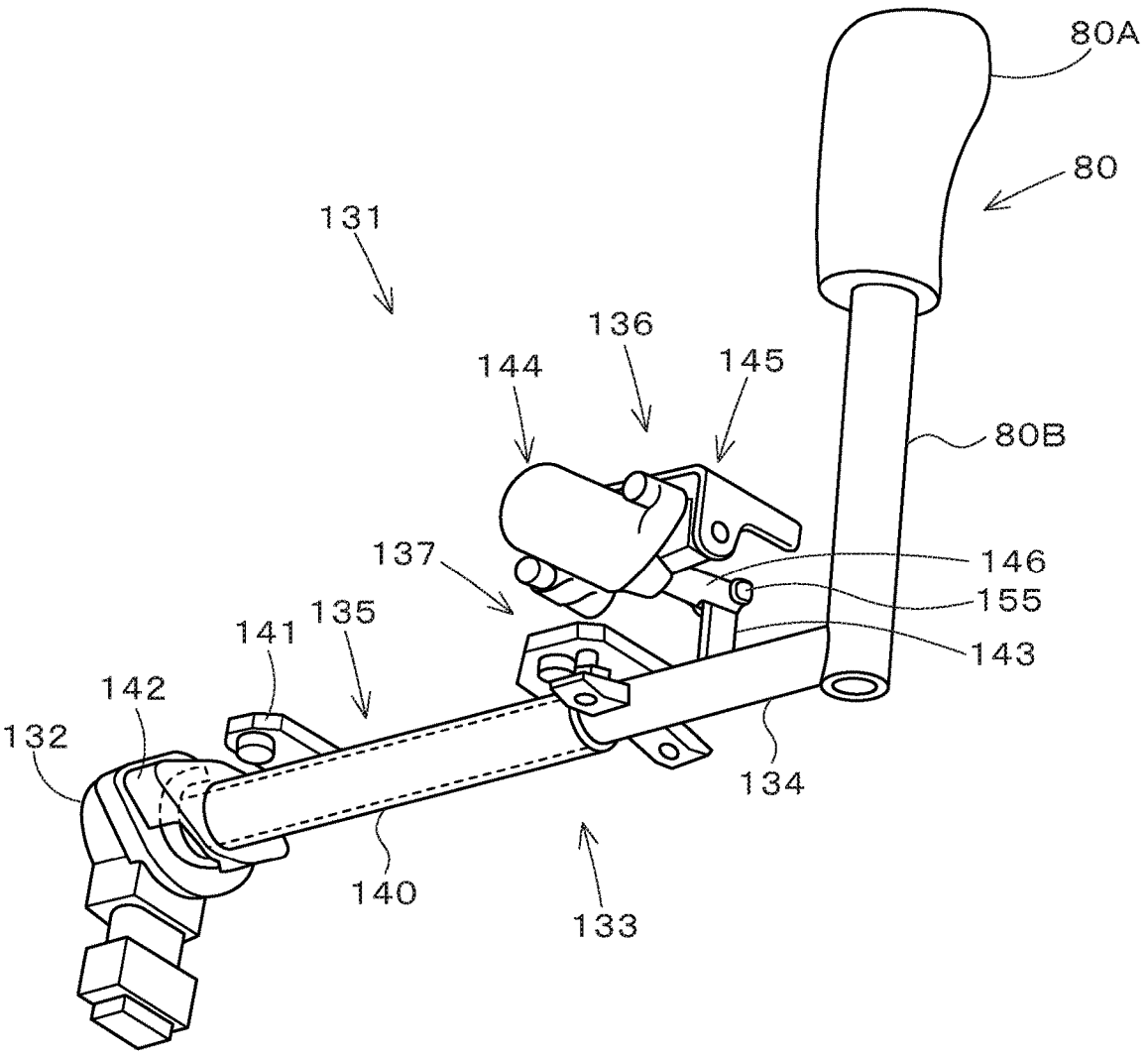
FIG. 22 is a perspective view of the supporting structure of the dozer lever.
Figure 24:
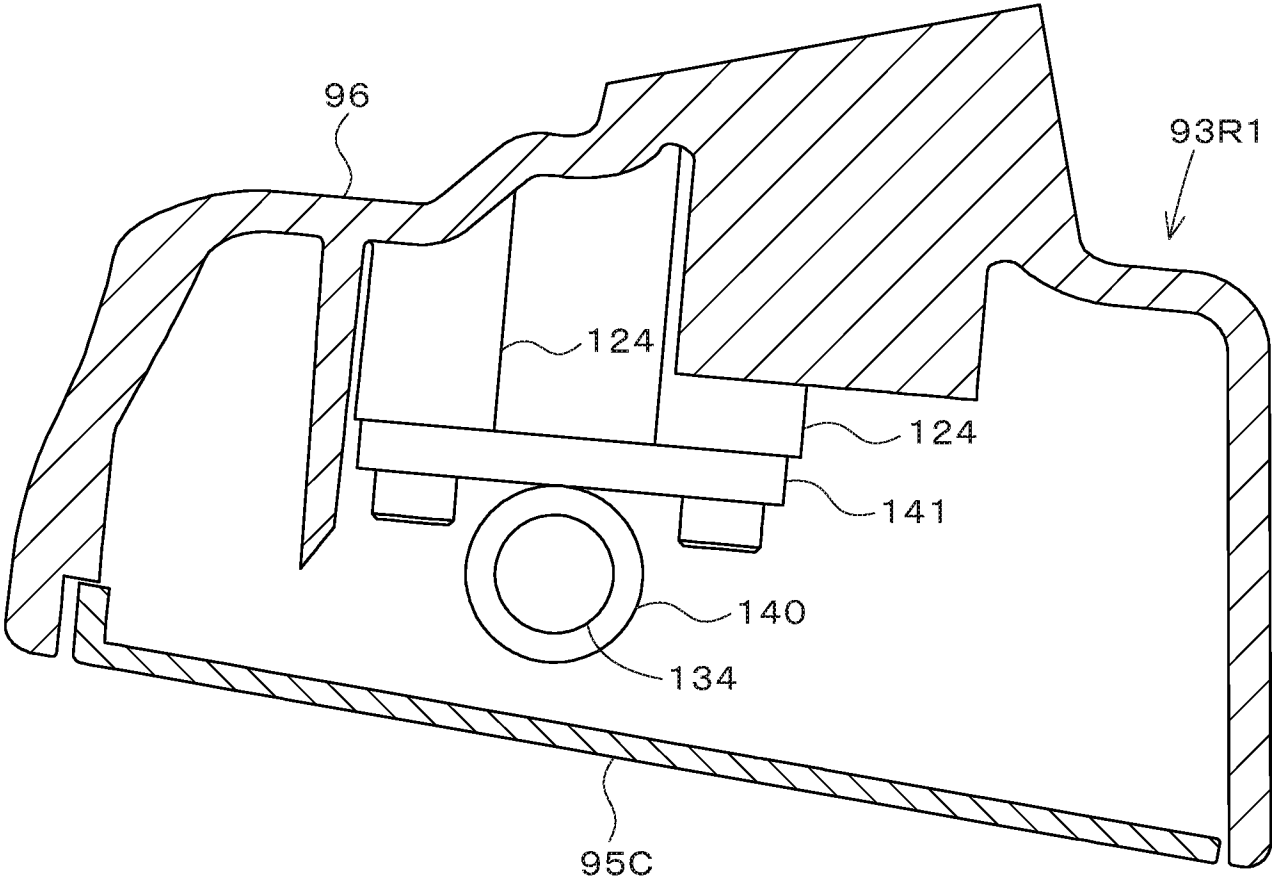
FIG. 24 is a right side view of a supporting portion of a rotary shaft.

As shown in FIG. 24, the attaching stay 141 is attached by, for example, a bolt to the attaching portion 124 protruding downward from a lower surface of the upper wall 96. As shown in FIGS. 21 and 22, the angle sensor 132 is attached to the sensor bracket 142.

Figure 23:
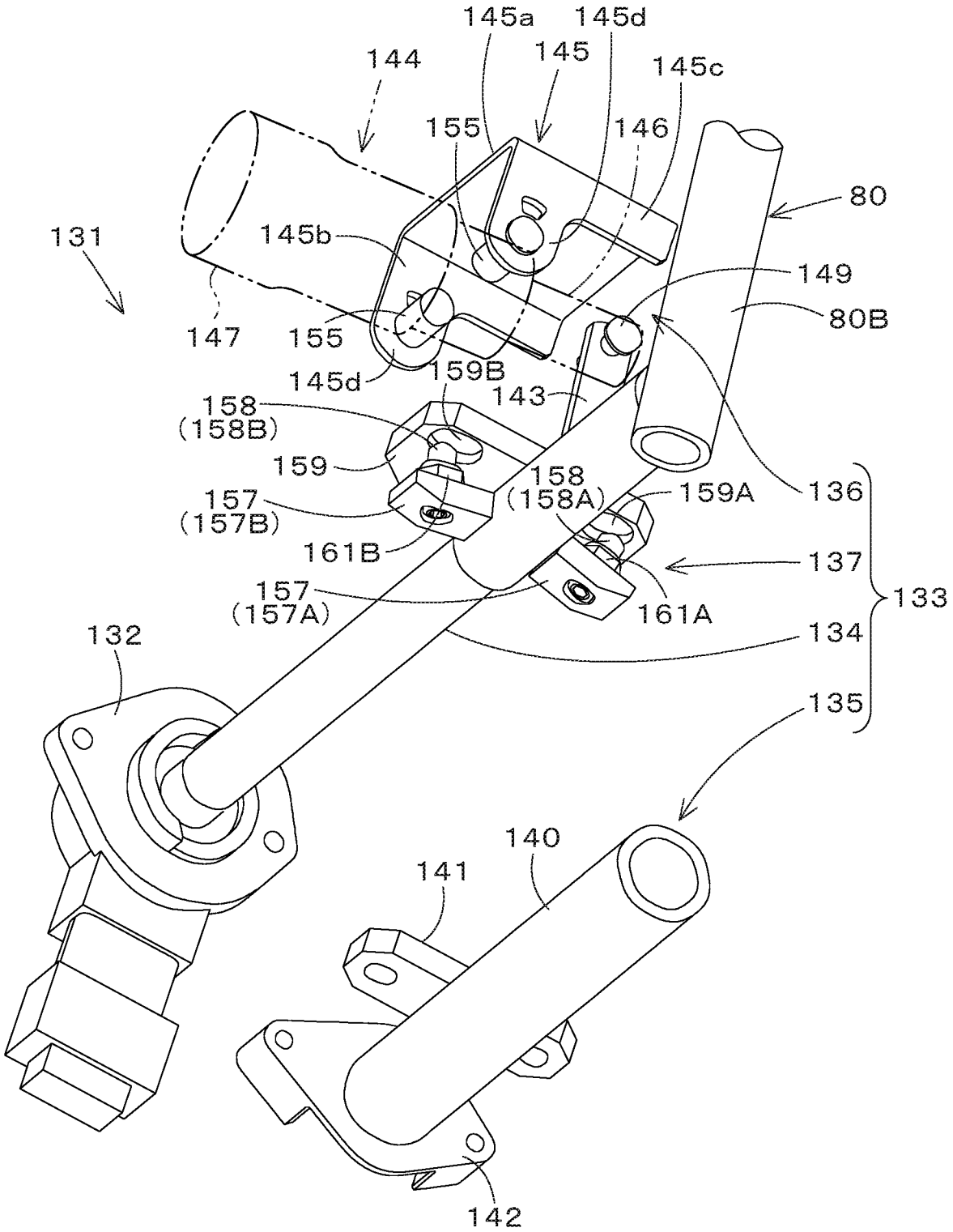
FIG. 23 is a partially exploded perspective view of the supporting structure of the dozer lever.
Figure 25:
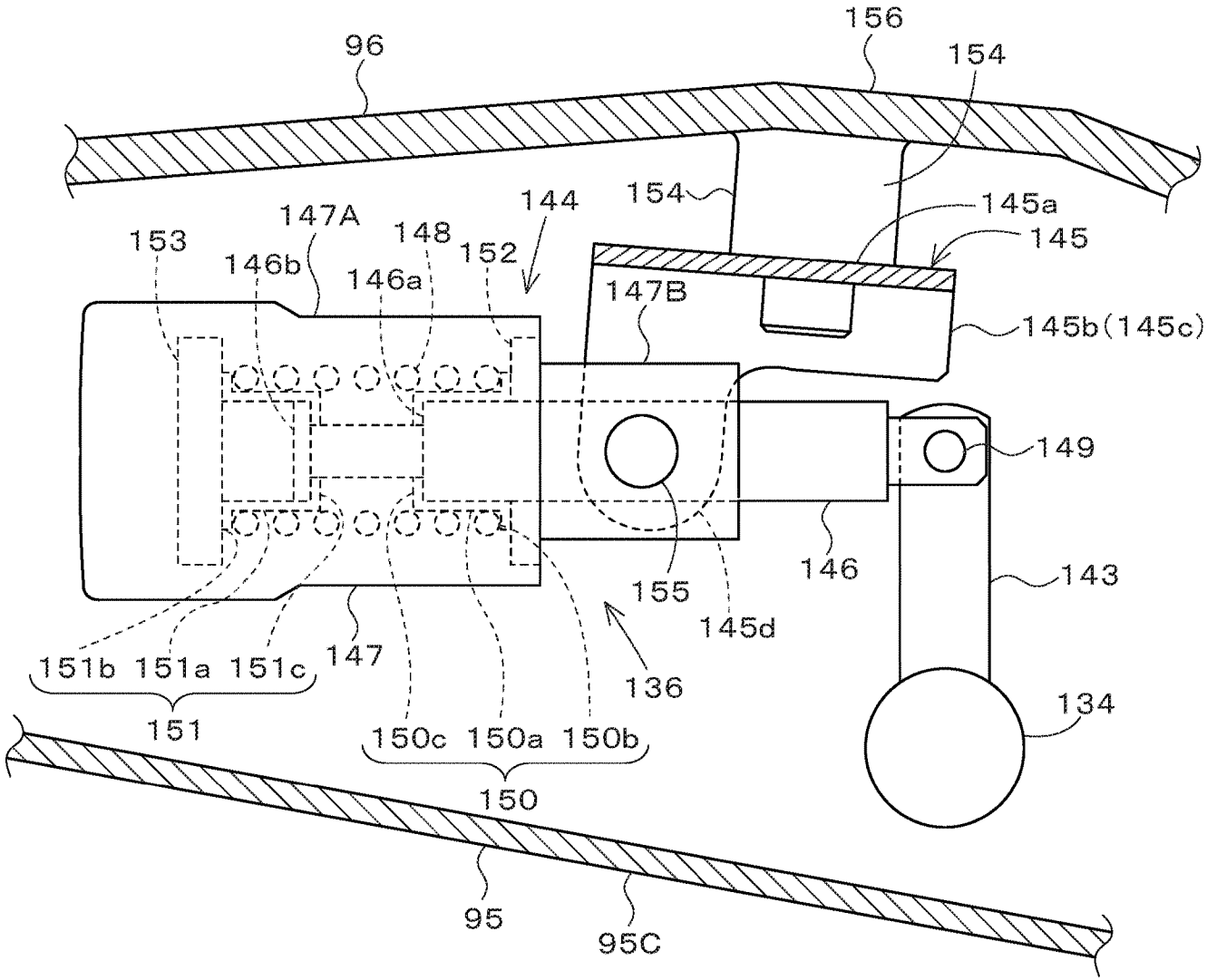
FIG. 25 is a right side view of a neutral return mechanism.

As shown in FIGS. 22, 23, and 25, the neutral return mechanism 136 is disposed above a right portion of the rotary shaft 134. Specifically, the neutral return mechanism 136 is disposed above a portion of the rotary shaft 134 protruding from the cylinder member 140 and between the upper wall 96 and the rotary shaft 134. The neutral return mechanism 136 has an interlock arm 143, a spring device 144, and a bracket member 145. The interlock arm 143 has its lower end fixed to the rotary shaft 134 and is provided so as to protrude upward from the rotary shaft 134. That is, the interlock arm 143 rotates together with the rotary shaft 134.

As shown in FIGS. 22, 23, and 25, the spring device 144 has an interlock shaft 146, a housing member 147, and a neutral return spring 148. The interlock shaft 146 is disposed above the rotary shaft 134 in a second horizontal direction 139 (see FIG. 20) intersecting (orthogonal to) the first horizontal direction 138. One end (front end) of the interlock shaft 146 is pivotally supported by and is connected to an upper portion of the interlock arm 143 through a pin 149. The housing member 147 is disposed rearward of the interlock shaft 146, and accommodates the other end (rear portion) of the interlock shaft 146. The interlock shaft 146 is supported by the housing member 147 so as to be movable in an axial direction, and is capable of moving into and out of the housing member 147.

As shown in FIG. 25, the neutral return spring 148 is a compression coil spring, and is accommodated in a spring accommodation portion 147A of the housing member 147. The neutral return spring 148 is disposed on an outer peripheral side of the interlock shaft 146 with its axial direction coinciding with the axial direction of the interlock shaft 146. Therefore, the neutral return spring 148, together with the interlock shaft 146, is disposed in the second horizontal direction 139. Consequently, the thickness of the neutral return mechanism 136 (the operation supporting mechanism 133) can be small. Components of the neutral return mechanism 136 are disposed above the rotary shaft 134. That is, the neutral return mechanism 136 do not have components protruding below the rotary shaft 134. Thus, when, for example, components are to be disposed below the rotary shaft 134, it is possible to prevent the neutral return mechanism 136 from interfering with such components.

A first spring receiving member 150 and a second spring receiving member 151 disposed rearward of the first spring receiving member 150 are provided inside the spring accommodation portion 147A. The neutral return spring 148 in a compressed state is interposed between the first spring receiving member 150 and the second spring receiving member 151. The first spring receiving member 150 has a cylinder portion 150*a* that is fitted to the outer periphery of the interlock shaft 146 so as to be movable relative thereto in the axial direction, a first part 150*b* that contacts a contact restricting member 152 provided in a fixed state at a front portion inside the spring accommodation portion 147A, and a second part 150*c* that engages with a stepped portion 146*a* of the interlock shaft 146. The second spring receiving member 151 has a cylinder portion 151*a* in which an end member 146*b* formed at a rear end of the interlock shaft 146 is accommodated so as to be movable relative thereto in the axial direction of the interlock shaft 146, a first part 151*b* that contacts a contact restricting member 153 provided in a fixed state at a rear portion inside the spring accommodation portion 147A, and a second part 151*c* that engages with the end member 146*b*.

As shown in FIGS. 23 and 25, the bracket member 145 has an upper wall 145*a*, a first side wall 145*b* extending downward from one edge (left edge) of the upper wall 145*a*, and a second side wall 145*c* extending downward from the other edge (right edge) of the upper wall 145*a*. The upper wall 145*a* is attached by, for example, a bolt to an attaching portion 154 protruding downward from a lower surface of a bracket attaching portion 156 of the upper wall 96 of the armrest base 93R1.

The first side wall 145*b* and the second side wall 145*c* each have at a rear portion thereof a pivotally supporting wall portion 145*d* formed to extend downward. Each pivotally supporting wall portion 145*d* is provided with a pivot pin 155. At a location between the first side wall 145*b* and the second side wall 145*c*, a supported portion 147B provided at a front portion of the housing member 147 is pivotally supported so as to be rotatable around an axis orthogonal to the axis of the interlock shaft 146 through the pivot pin 155.

At the neutral return mechanism 136 above, when the dozer lever 80 is swung forward from the neutral position, the rotary shaft 134 rotates and the interlock shaft 146 moves forward such that the interlock arm 143 swings forward. This causes the second spring receiving member 151, together with the end member 146*b*, to move forward and the neutral return spring 148 to be compressed. When the dozer lever 80 is swung rearward from the neutral position, the rotary shaft 134 rotates and the interlock shaft 146 moves rearward such that the interlock arm 143 swings rearward. This causes the first spring receiving member 150, together with the stepped portion 146*a* of the interlock shaft 146, to move rearward and the neutral return spring 148 to be compressed. When the swinging of the dozer lever 80 is stopped, a biasing force of the neutral return spring 148 causes the dozer lever 80 to return to the neutral position from a post-operation position which is a position to which the dozer lever 80 has been moved (swung). The dozer lever 80 is subjected to an operation load by the neutral return spring 148.

As shown in FIG. 21, the bracket attaching portion 156 to which the bracket member 145 at the upper wall 96 is attached is formed so as to be recessed from a lower side to an upper side. This makes it possible to increase the height of the lower surface of the second armrest 93R and to widen a lower space of the second armrest 93R.

Figure 26:
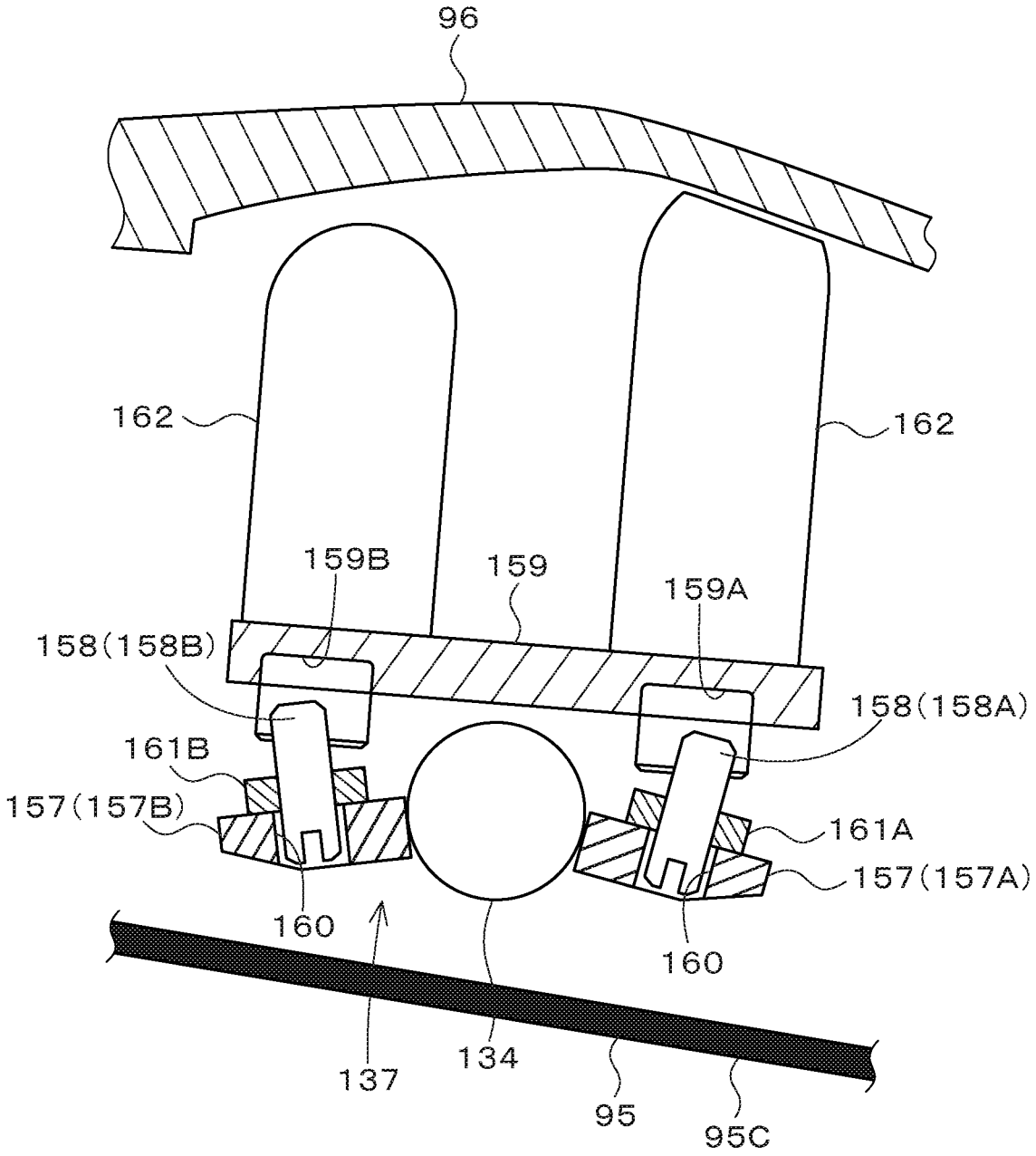
FIG. 26 is a right side view of a swing restricting mechanism.

As shown in FIGS. 23 and 26, the swing restricting mechanism 137 is disposed side by side with the neutral return mechanism 136 along the rotary shaft 134. Specifically, the swing restricting mechanism 137 is disposed on the left of the neutral return mechanism 136. It is possible to decrease the thickness of the operation supporting mechanism 133 in an up-down direction by disposing the swing restricting mechanism 137 side by side with the neutral return mechanism 136 along the rotary shaft 134.

The swing restricting mechanism 137 has at least one supporting part 157 that is fixed to the rotary shaft 134, at least one restricting shaft 158 that is provided at the at least one supporting part 157, and a contact member 159 that is disposed above the rotary shaft 134 so as to be opposite to the at least one supporting part 157.

The at least one supporting part 157 protrudes from the rotary shaft 134 in the second horizontal direction 139. Specifically, the supporting part 157 includes a first supporting part 157A protruding from the rotary shaft 134 toward one side (forward) in the second horizontal direction 139, and a second supporting part 157B protruding from the rotary shaft 134 toward the other side (rearward) in the second horizontal direction 139. The first supporting part 157A and the second supporting part 157B each have an insertion hole 160 as a through hole. A nut member 161A is fixed to an upper surface of a portion of the first supporting part 157A where the insertion hole 160 is formed. A nut member 161B is also fixed to an upper surface of a portion of the second supporting part 157B where the insertion hole 160 is formed.

The at least one restricting shaft 158 is attached to a corresponding one of the supporting parts 157 so as to be movable toward and away from the contact member 159, and restricts the swinging of the dozer lever 80 by contacting the contact member 159 when the dozer lever 80 swings from the neutral position. Specifically, the at least one restricting shaft 158 includes a first restricting shaft 158A that is attached to the first supporting part 157A, and a second restricting shaft 158B that is attached to the second supporting part 157B; and the first restricting shaft 158A is inserted through the insertion hole 160 of the first supporting part 157A and is screwed into the nut member 161A, and the second restricting shaft 158B is inserted through the insertion hole 160 of the second supporting part 157B and is screwed into the nut member 161B. The first restricting shaft 158A is screwed toward or away from the nut member 161A, as a result of which the first restricting shaft 158A moves toward and away from the contact member 159; and the second restricting shaft 158B is screwed toward and away from the nut member 161B, as a result of which the second restricting shaft 158B moves toward and away from the contact member 159. Therefore, it is possible to adjust the operation amount of the dozer lever 80 from the neutral position. The first restricting shaft 158A and the second restricting shaft 158B are inserted into the respective insertion holes 160 so as not to protrude below the respective insertion holes 160, and an upper portion of the first restricting shaft 158A and an upper portion of the second restricting shaft 158B protrude upward from a corresponding one of the nut members 161A and 161B.

As shown in FIG. 26, the contact member 159 is formed from a plate material, and is disposed above the rotary shaft 134 and the supporting parts 157 such that its plate surface is oriented in an up-down direction. The contact member 159 is disposed opposite to the supporting parts 157 (the first supporting part 157A and the second supporting part 157B). The contact member 159 has a first restricting portion 159A contacted by the first restricting shaft 158A when the dozer lever 80 is operated toward one side from the neutral position, and a second restricting portion 159B contacted by the second restricting shaft 158B when the dozer lever 80 is operated toward another side from the neutral position. The first restricting portion 159A and the second restricting portion 159B are formed so as to be recessed upward from a lower surface of the contact member 159. Therefore, it is possible to decrease the interval between the rotary shaft 134 and the contact member 159.

At the swing restricting mechanism 137 above, the first supporting part 157A protrudes from the rotary shaft 134 toward one side (forward) in the second horizontal direction 139, the second supporting part 157B protrudes from the rotary shaft 134 toward the other side (rearward) in the second horizontal direction 139, and the contact member 159 that is formed from a plate material is disposed above the first supporting part 157A and the second supporting part 157B such that its plate surface is oriented in the up-down direction, as a result of which the thickness in the up-down direction can be decreased.

At the manipulator mechanism 131, since the thickness of the operation supporting mechanism 133 is small, it is possible to effectively use a lower space of the operation supporting mechanism 133. For example, as shown in FIG. 27, a duct 66C that branches off from the duct 66B can be made to pass below the second armrest 93R.

The manipulator mechanism 131 is not limited to a mechanism that manipulates the dozer device 7, and, as the operation member, for example, a traveling pedal, a swing operation member that operates a swing bracket, or an AUX pedal that operates an attachment that is mounted in place of or together with the bucket may be used.

The manipulator mechanism 131 is not limited to being provided at the manipulator base 81 disposed forward of the operator's seat 6, and may be installed on a manipulator base 81 provided beside the operator's seat 6, or may be provided on the floor constituting an upper surface of the machine body. Since the manipulator mechanism 131 does not have components protruding downward from the rotary shaft 134, it is possible to prevent interference with, for example, members that are disposed below the rotary shaft 134.

A working machine 1 according to one or more embodiments includes: a machine body 2; an operator's seat 6 on the machine body 2; and a manipulator base 81 provided forward of the operator's seat 6 on the machine body 2 and having attached thereto a manipulator member 82 to be held and operated, wherein the manipulator base 81 includes a flip-up armrest (first armrest 93L) extending in a rearward direction away from the manipulator base 81, the flip-up armrest 93L is configured to be switchable between a first orientation 98 that does not allow an operator to sit on or get off the operator's seat 6 and a second orientation 99 that allows the operator to sit on and get off the operator's seat 6, and configured such that, when the flip-up armrest 93L is in the first orientation 98, an actuation of an operation object to be operated by the manipulator member 82 is allowed, and, when the flip-up armrest 93L is in the second orientation 99, the actuation of the operation object is not allowed.

With the configuration, since the armrest 93L has the function of allowing and preventing the actuation of an operation object that is operated by the manipulator member 82, it is possible to simplify the structure and reduce costs.

The manipulator base 81 may include a base portion 86 extending upward from the machine body 2, and a manipulator base body 87 disposed on an upper portion of the base portion 86. The manipulator base body 87 may include an attaching portion 92 to be attached to the base portion 86, and the flip-up armrest 93L. The flip-up armrest 93L may include an armrest base 93L1 provided beside the attaching portion 92, and an armrest body 93L2 pivotally supported by the armrest base 93L1. The armrest body 93L2 may be switchable between a lowered position 100 in which the armrest body 93L2 extends rearward from the armrest base 93L1 such that the flip-up armrest 93L is in the first orientation 98, and a raised position 101 in which the armrest body 93L2 has been rotated upward from the lowered position 100 such that the flip-up armrest 93L is in the second orientation 99.

With the configuration, it is possible to easily switch the armrest 93L between the first orientation 98 and the second orientation 99 by rotating the armrest body 93L2 from the lowered position 100 to the raised position 101.

The working machine 1 may further include a detection switch 102 to detect a position of the armrest body 93L2.

With the configuration, it is possible to detect the first orientation 98 and the second orientation 99.

The working machine 1 may further include a damper 122 provided on one of the armrest base 93L1 and the armrest body 93L2 and configured to contact the other of the armrest base 93L1 and the armrest body 93L2 to reduce shock produced when the armrest body 93L2 is rotated from the raised position 101 to the lowered position 100.

With the configuration, even if the armrest body 93L2 is lowered violently, it is possible to eliminate or reduce the likelihood that a loud sound or a large vibration will be produced and possible to improve comfortability.

The working machine 1 may further include a holding mechanism 108 to hold the armrest body 93L2 in the lowered position 100 and the raised position 101.

With the configuration, it is possible to hold the armrest body 93L2 in the lowered position 100 and in the raised position 101.

The working machine 1 may further include a fixed-side member 104 attached to the armrest base 93L1, and a shaft 106 supported by the fixed-side member 104 to rotate together with the armrest body 93L2. The fixed-side member 104 may include a first supporting portion 104B1 to support one of opposite ends of the shaft 106 in an axial direction, and a second supporting portion 104B2 to support the other of the opposite ends of the shaft 106 in the axial direction. The holding mechanism 108 may be provided between the first supporting portion 104B1 and the second supporting portion 104B2.

With the configuration, it is possible to configure the holding mechanism 108 and a rotary mechanism rotatably supporting the armrest body 93L2 in a compact manner.

The holding mechanism 108 may include a first member (first cam 126) attached to the fixed-side member 104, a second member (second cam 127) supported such that the second member is rotatable together with the shaft 106 and slidable in an axial direction, and a spring member 128 to push the second member 127 against the first member 126.

With the configuration, it is possible to place the holding mechanism 108 around the shaft 106 in a compact manner.

The holding mechanism 108 may include a cam protrusion 129 provided on one of the first member 126 and the second member 127, and a cam inclined surface 130 provided on the other of the first member 126 and the second member 127 to contact the cam protrusion 129. The cam protrusion 129 and the cam inclined surface 130 may be configured to contact each other to cause a biasing force of the spring member 128 to act such that the armrest body 93L2 is rotated toward the lowered position 100 at a position between (i) the lowered position 100 and (ii) an intermediate position between the lowered position 100 and the raised position 101, and that the armrest body 93L2 is rotated toward the raised position 101 at a position between the raised position 101 and the intermediate position.

With the configuration, it is possible to assist the armrest body 93L2 in rotating.

The holding mechanism 108 may be configured such that, when the armrest body 93L2 is in the raised position 101, the cam protrusion 129 and the cam inclined surface 130 contact each other to cause a biasing force of the spring member 128 to act in a direction in which the armrest body 93L2 is rotated from the lowered position 100 to the raised position 101.

With the configuration, it is possible to firmly maintain the raised position 101 of the armrest body 93L2.

The working machine 1 may further include: a damper 122 provided on one of the armrest base 93L1 and the armrest body 93L2 and configured to contact the other of the armrest base 93L1 and the armrest body 93L2 to reduce shock produced when the armrest body 93L2 is rotated from the raised position 101 to the lowered position 100; and a moving-side member 107 attached to the armrest body 93L2 to rotate together with the shaft 106. The damper 122 may be provided on the armrest base 93L1. The moving-side member 107 may include a damper contacting portion (first contacting portion 120) to contact the damper 122.

With the configuration, it is possible to reduce parts count and simplify the structure because the moving-side member 107 is provided with a damper contacting portion 120 that contacts the damper 122.

A working machine 1 according to one or more embodiments includes: a machine body 2; an operator's seat 6 on the machine body 2; a manipulator base 81 provided forward of the operator's seat 6; an operation member (dozer lever 80) swingable and disposed at the manipulator base 81; and an operation supporting mechanism 133 to support the operation member 80, wherein the manipulator base 81 includes an armrest (second armrest 93R) having a hollow and extending in a rearward direction away from the manipulator base 81, and the operation supporting mechanism 133 includes a neutral return mechanism 136 to return the operation member 80 to a neutral position from a post-operation position and a swing restricting mechanism 137 to limit an operation amount of the operation member 80 from the neutral position, and is contained inside the hollow of the armrest 93R, the post-operation position being a position to which the operation member 80 has been moved.

With the configuration, since the operation supporting mechanism 133 including the neutral return mechanism 136 and the swing restricting mechanism 137 is contained inside the hollow of the armrest 93R, it is possible to prevent the operation supporting mechanism 133 that supports the operation member 80 from protruding below the armrest 93R.

The operation supporting mechanism 133 may include a rotary shaft 134 rotatable about an axis in response to a swinging operation of the operation member 80, and a shaft supporting member 135 to support the rotary shaft 134 such that the rotary shaft 134 is rotatable about the axis. The rotary shaft 134 may be disposed below an upper wall 96 of the armrest 93R and is disposed such that the rotary shaft 134 protrudes in a machine-body width direction K2 from one of opposite sides of the armrest 93R in the machine-body width direction K2.

With the configuration, the operation member 80 that is operated in a front-rear direction can be supported by the rotary shaft 134 with a simple structure.

The neutral return mechanism 136 may include a spring device 144 and a bracket member 145, the spring device 144 being disposed between the upper wall 96 and the rotary shaft 134 and including a neutral return spring 148 to return the operation member 80 to the neutral position, the bracket member 145 supporting the spring device 144 and being attached to the upper wall 96. A bracket attaching portion 156 of the upper wall 96 to which the bracket member 145 is attached may be recessed in a direction from a below to above.

With the configuration, it is possible to increase the height of the lower surface of the second armrest 93R and to widen a lower space of the second armrest 93R.

The swing restricting mechanism 137 and the neutral return mechanism 136 may be arranged along the rotary shaft 134.

With the configuration, since the neutral return mechanism 136 and the swing restricting mechanism 137 are arranged lateral to each other, it is possible to configure the operation supporting mechanism 133 in a compact manner.

The swing restricting mechanism 137 may include at least one supporting part 157 fixed to the rotary shaft 134, a contact member 159 facing the at least one supporting part 157, and at least one restricting shaft 158 attached to the at least one supporting part 157 such that the at least one restriction shaft 158 is movable toward and away from the contact member 159 and to restrict swinging of the operation member 80 by contacting the contact member 159 when the operation member 80 swings from the neutral position.

With the configuration, it is possible to adjust the operation amount of the operation member 80 from the neutral position.

The at least one supporting part 157 may include a first supporting part 157A that protrudes forward from the rotary shaft 134, and a second supporting part 157B that protrudes rearward from the rotary shaft 134. The at least one restricting shaft 158 may include a first restricting shaft 158A attached to the first supporting part 157A, and a second restricting shaft 158B attached to the second supporting part 157B. The contact member 159 may be disposed above the rotary shaft 134, and include a first restricting portion 159A contacted by the first restricting shaft 158A when the operation member 80 is operated in a first direction from the neutral position, and a second restricting portion 159B contacted by the second restricting shaft 158B when the operation member 80 is operated in a second direction from the neutral position. The first restricting portion 159A and the second restricting portion 159B may be recessed upward from the lower surface of the contact member 159.

With the configuration, it is possible to reduce the gap between the rotary shaft 134 and the contact member 159.

The manipulator base 81 may include a base portion 86 extending upward from the machine body 2, and a manipulator base body 87 disposed on an upper portion of the base portion 86. The manipulator base body 87 may include an attaching portion 92 to be attached to the base portion 86, and the armrest 93R. The armrest 93R may include an armrest base 93R1 provided beside the attaching portion 92, and an armrest body 93R2 extending toward the operator's seat 6 from the armrest base 93R1. The operation member 80 may be located on the opposite side of the armrest base 93R1 from the attaching portion 92. The operation supporting mechanism 133 may be contained in the armrest base 93R1.

With the configuration, the operation supporting mechanism 133 that supports the operation member 80 located on the opposite side of the armrest base 93R1 from the attaching portion 92 can be properly contained in the armrest 93R.

The working machine 1 further may include an angle sensor 132 to detect an operation direction and an operation amount of the operation member 80. The angle sensor 132 may be contained in the attaching portion 92.

Since the angle sensor 132 is contained in the attaching portion 92, it is possible to prevent a portion protruding downward from the lower surface of the armrest 93R from being formed.

A manipulator mechanism 131 according to one or more embodiments includes: a rotary shaft 134 rotatable about an axis extending in a first horizontal direction 138; an operation member (dozer lever 80) disposed at one of opposite ends of the rotary shaft 134 in an axial direction thereof to rotate together with the rotary shaft 134; an angle sensor 132 disposed at the other of the opposite ends of the rotary shaft 134 in the axial direction to detect a rotation angle of the rotary shaft 134; and a neutral return mechanism 136 provided between the operation member 80 and the angle sensor 132 to return the operation member 80 to a neutral position from a post-operation position, the post-operation position being a position to which the operation member has been moved.

With the configuration, it is possible to reduce the thickness of the manipulator mechanism 131 in an up-down direction. This makes it possible to effectively use the space below the manipulator mechanism 131.

The neutral return mechanism 136 may include an interlock shaft 146 disposed higher than the rotary shaft 134 and extending in a second horizontal direction 139 intersecting the first horizontal direction 138, an interlock arm 143 to which one of opposite ends of the interlock shaft 146 is pivotally supported and connected, the interlock arm 143 being provided on the rotary shaft 134 such that the interlock arm 143 protrudes upward from the rotary shaft 134, and a neutral return spring 148 including a coil spring fitted on the other of the opposite ends of the interlock shaft 146 to bias the interlock shaft 146 to return the operation member 80 to the neutral position.

With the configuration, it is possible to further reduce the thickness of the manipulator mechanism 131 in the up-down direction.

The neutral return mechanism 136 may include a bracket member 145 disposed higher than the rotary shaft 134 and pivotally supporting a housing member 147 that contains the other of the opposite ends of the interlock shaft 146 and the neutral return spring 148.

With the configuration, it is possible to place the neutral return mechanism 136 higher than the rotary shaft 134, thus making it possible to eliminate or reduce the likelihood that components will protrude below a rotary member and to prevent or reduce interference with members located below the rotary shaft 134.

The manipulator mechanism 131 may further include a swing restricting mechanism 137 to limit an operation amount of the operation member 80 from the neutral position, the swing restricting mechanism 137 and the neutral return mechanism 136 being arranged along the rotary shaft 134 between the operation member 80 and the angle sensor 132.

With the configuration, since the neutral return mechanism 136 and the swing restricting mechanism 137 are arranged lateral to each other, it is possible to reduce the thickness of the manipulator mechanism 131 in the up-down direction.

The swing restricting mechanism 137 may include at least one supporting part 157 protruding from the rotary shaft 134 in the second horizontal direction 139, at least one restricting shaft 158 attached to the at least one supporting part 157, and a contact member 159 disposed higher than the rotary shaft 134, the contact member 159 being configured to be contacted by the at least one restricting shaft 158 when the operation member 80 is in the post-operation position to restrict swinging of the operation member 80, the post-operation position being a position to which the operation member 80 has been moved from the neutral position.

With the configuration, it is possible to place the swing restricting mechanism 137 higher than the rotary shaft 134, thus making it possible to eliminate or reduce the likelihood that components will protrude below a rotary member and to prevent or reduce interference with members located below the rotary shaft 134.

The at least one supporting part 157 may include a first supporting part 157A and a second supporting part 157B protruding opposite to each other along the second horizontal direction 139 from the rotary shaft 134. The at least one restricting shaft 158 may include a first restricting shaft 158A attached to the first supporting part 157A and configured to contact the contact member 159 when the operation member 80 is moved in a first direction from the neutral position, and a second restricting shaft 158B attached to the second supporting part 157B and configured to contact the contact member 159 when the operation member 80 is moved in a second direction from the neutral position. The first restricting shaft 158A and the second restricting shaft 158B may be attached such that the first restricting shaft 158A and the second restricting shaft 158B are movable toward and away from the contact member 159.

With the configuration, it is possible to reduce the thickness of the manipulator mechanism 131 in the up-down direction.

The contact member 159 may include a first restricting portion 159A to be contacted by the first restricting shaft 158A and a second restricting portion 159B to be contacted by the second restricting shaft 158B. The first restricting portion 159A and the second restricting portion 159B may be recessed upward from a lower surface of the contact member 159.

With the configuration, it is possible to reduce the gap between the rotary shaft 134 and the contact member 159, and to reduce the thickness of the manipulator mechanism 131 in the up-down direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A manipulator mechanism comprising:

a rotary shaft rotatable about an axis extending in a first horizontal direction;

an operation member disposed at one of opposite ends of the rotary shaft in an axial direction thereof to rotate together with the rotary shaft;

an angle sensor disposed at the other of the opposite ends of the rotary shaft in the axial direction to detect a rotation angle of the rotary shaft; and a neutral return mechanism provided between the operation member and the angle sensor to return the operation member to a neutral position from a post-operation position, the post-operation position being a position to which the operation member has been moved, wherein the neutral return mechanism includes an interlock shaft disposed higher than the rotary shaft and extending in a second horizontal direction intersecting the first horizontal direction, an interlock arm to which one of opposite ends of the interlock shaft is pivotally supported and connected, the interlock arm being provided on the rotary shaft such that the interlock arm protrudes upward from the rotary shaft, and a neutral return spring including a coil spring fitted on the other of the opposite ends of the interlock shaft to bias the interlock shaft to return the operation member to the neutral position.

2. The manipulator mechanism according to claim 1, wherein the neutral return mechanism includes a bracket member disposed higher than the rotary shaft and pivotally supporting a housing member that contains the other of the opposite ends of the interlock shaft and the neutral return spring.

3. The manipulator mechanism according to claim 1, further comprising:

a swing restricting mechanism to limit an operation amount of the operation member from the neutral position, the swing restricting mechanism and the neutral return mechanism being arranged along the rotary shaft between the operation member and the angle sensor.

4. The manipulator mechanism according to claim 3, wherein the swing restricting mechanism includes at least one supporting part protruding from the rotary shaft in a second horizontal direction, at least one restricting shaft attached to the at least one supporting part, and a contact member disposed higher than the rotary shaft, the contact member being configured to be contacted by the at least one restricting shaft when the operation member is in the post-operation position to restrict swinging of the operation member, the post-operation position being a position to which the operation member has been moved from the neutral position.

5. The manipulator mechanism according to claim 4, wherein the at least one supporting part includes a first supporting part and a second supporting part protruding opposite to each other along the second horizontal direction from the rotary shaft, the at least one restricting shaft includes a first restricting shaft attached to the first supporting part and configured to contact the contact member when the operation member is moved in a first direction from the neutral position, and a second restricting shaft attached to the second supporting part and configured to contact the contact member when the operation member is moved in a second direction from the neutral position, and the first restricting shaft and the second restricting shaft are attached such that the first restricting shaft and the second restricting shaft are movable toward and away from the contact member.

6. The manipulator mechanism according to claim 5, wherein the contact member includes a first restricting portion to be contacted by the first restricting shaft and a second restricting portion to be contacted by the second restricting shaft, and the first restricting portion and the second restricting portion are recessed upward from a lower surface of the contact member.

7. A working machine comprising:

the manipulator mechanism according to claim 1.

8. The working machine according to claim 7, further comprising:

a machine body;

an operator's seat on the machine body;

a manipulator base provided forward of the operator's seat;

an operation member swingable and disposed at the manipulator base; and an operation supporting mechanism to support the operation member, wherein the manipulator base includes an armrest having an upper portion and a lower portion that form a hollow portion therebetween, and the armrest extends in a rearward direction away from the manipulator base to reach an area at one side of the operator's seat, and the operation supporting mechanism includes the neutral return mechanism and a swing restricting mechanism to limit an operation amount of the operation member from a neutral position thereof, and is contained inside the hollow portion of the armrest.

9. A working machine comprising:

a machine body;

an operator's seat on the machine body;

a manipulator base provided forward of the operator's seat;

an operation member swingable and disposed at the manipulator base; and an operation supporting mechanism to support the operation member, wherein the manipulator base includes an armrest having an upper portion and a lower portion that form a hollow portion therebetween, and the armrest extends in a rearward direction away from the manipulator base to reach an area at one side of the operator's seat, and the operation supporting mechanism includes a neutral return mechanism to return the operation member to a neutral position from a post-operation position and a swing restricting mechanism to limit an operation amount of the operation member from the neutral position, and is contained inside the hollow portion of the armrest, the post-operation position being a position to which the operation member has been moved.

10. The working machine according to claim 9, wherein the operation supporting mechanism includes a rotary shaft rotatable about an axis in response to a swinging operation of the operation member, and a shaft supporting member to support the rotary shaft such that the rotary shaft is rotatable about the axis, and the rotary shaft is disposed below an upper wall of the armrest and is disposed such that the rotary shaft protrudes in a machine-body width direction from one of opposite sides of the armrest in the machine-body width direction.

11. The working machine according to claim 9, wherein the armrest extends in a rearward direction away from one of opposite ends in a machine-body width direction of the manipulator base, the manipulator base includes a manipulator member attached to the manipulator base to be held and operated by an operator, and a flip-up armrest extending in a rearward direction away from the other of the opposite ends in the machine-body width direction of the manipulator base, the flip-up armrest is configured to be switchable between a first orientation that does not allow the operator to sit on or get off the operator's seat and a second orientation that allows the operator to sit on and get off the operator's seat, and configured such that, when the flip-up armrest is in the first orientation, an actuation of an operation object to be operated by the manipulator member is allowed, and, when the flip-up armrest is in the second orientation, the actuation of the operation object is not allowed.

12. A working machine comprising:

a machine body;

an operator's seat on the machine body; and a manipulator base provided forward of the operator's seat on the machine body and having attached thereto a manipulator member to be held and operated, wherein the manipulator base includes a flip-up armrest extending in a rearward direction away from the manipulator base, the flip-up armrest is configured to be switchable between a first orientation that does not allow an operator to sit on or get off the operator's seat and a second orientation that allows the operator to sit on and get off the operator's seat, and configured such that, when the flip-up armrest is in the first orientation, an actuation of an operation object to be operated by the manipulator member is allowed, and, when the flip-up armrest is in the second orientation, the actuation of the operation object is not allowed.

13. The working machine according to claim 12, wherein the manipulator base includes a base portion extending upward from the machine body, and a manipulator base body disposed on an upper portion of the base portion, the manipulator base body includes an attaching portion to be attached to the base portion, and the flip-up armrest, the flip-up armrest includes an armrest base provided beside the attaching portion, and an armrest body pivotally supported by the armrest base, and the armrest body is switchable between a lowered position in which the armrest body extends rearward from the armrest base such that the flip-up armrest is in the first orientation, and a raised position in which the armrest body has been rotated upward from the lowered position such that the flip-up armrest is in the second orientation.

14. The working machine according to claim 13, further comprising:

a detection switch to detect a position of the armrest body.

15. The working machine according to claim 13, further comprising:

a damper provided on one of the armrest base and the armrest body and configured to contact the other of the armrest base and the armrest body to reduce shock produced when the armrest body is rotated from the raised position to the lowered position.

16. The working machine according to claim 13, further comprising:

a holding mechanism to hold the armrest body in the lowered position and the raised position.

17. The working machine according to claim 13, further comprising:

a damper provided on one of the armrest base and the armrest body and configured to contact the other of the armrest base and the armrest body to reduce shock produced when the armrest body is rotated from the raised position to the lowered position; and a moving-side member attached to the armrest body to rotate together with a shaft, wherein the damper is provided on the armrest base, and the moving-side member includes a damper contacting portion to contact the damper.

* * * * *